US011145236B2

(12) United States Patent
Baek

(10) Patent No.: US 11,145,236 B2
(45) Date of Patent: Oct. 12, 2021

(54) DISPLAY DEVICE AND METHOD OF DRIVING THE SAME

(71) Applicant: Samsung Display Co., Ltd., Yongin-si (KR)

(72) Inventor: Eun Ryeol Baek, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/851,811

(22) Filed: Apr. 17, 2020

(65) Prior Publication Data

US 2021/0118352 A1 Apr. 22, 2021

(30) Foreign Application Priority Data

Oct. 16, 2019 (KR) ..... 10-2019-0128711

(51) Int. Cl.
*G09G 3/20* (2006.01)

(52) U.S. Cl.
CPC ..... *G09G 3/2007* (2013.01); *G09G 2310/08* (2013.01); *G09G 2320/0209* (2013.01)

(58) Field of Classification Search
CPC ... G09G 2320/0276; G09G 2320/0673; G09G 2320/0233
See application file for complete search history.

(56) References Cited

U.S. PATENT DOCUMENTS

| | | | | |
|---|---|---|---|---|
| 9,646,560 | B2 | 5/2017 | Kim et al. | |
| 9,761,178 | B2 | 9/2017 | Park et al. | |
| 2013/0249881 | A1 | 9/2013 | Chae et al. | |
| 2016/0049113 | A1* | 2/2016 | Park | G09G 3/3266 345/212 |
| 2021/0043150 | A1* | 2/2021 | Lee | G09G 3/3291 |

FOREIGN PATENT DOCUMENTS

| | | | |
|---|---|---|---|
| KR | 10-2013-0108962 | A | 10/2013 |
| KR | 10-2015-0142153 | A | 12/2015 |
| KR | 10-2016-0050166 | A | 5/2016 |

* cited by examiner

*Primary Examiner* — Gerald Johnson
(74) *Attorney, Agent, or Firm* — Lewis Roca Rothgerber Christie LLP

(57) ABSTRACT

A display device includes: a display unit including a plurality of pixels to display an image according to a driving voltage; a data driver to provide data signals to the plurality of pixels; a gamma voltage generator to provide a plurality of grayscale voltages to the data driver; and a reference voltage generator to provide a first reference voltage and a second reference voltage to the gamma voltage generator. The gamma voltage generator is to generate the plurality of grayscale voltages by dividing the first reference voltage and the second reference voltage, and the reference voltage generator is to generate a sensing driving voltage by measuring the driving voltage from the display unit, and to generate the first reference voltage and the second reference voltage by utilizing the sensing driving voltage and a reference driving voltage.

20 Claims, 15 Drawing Sheets

DISPLAY DEVICE AND METHOD OF DRIVING THE SAME

CROSS-REFERENCE TO RELATED APPLICATION

This application claims priority to and the benefit of Korean Patent Application No. 10-2019-0128711, filed on Oct. 16, 2019, the entire content of which is incorporated by reference herein.

BACKGROUND

1. Field

Aspects of example embodiments of the present disclosure relate to a display device and a method of driving the display device.

2. Description of the Related Art

Importance of a display device is increasing with the development of multimedia. Thus, various display devices, for example, such as a liquid crystal display (LCD) device and an organic light emitting diode (OLED) display device, have been developed.

The display device includes a display unit and a driver. The display unit includes a plurality of pixels. The driver includes a scan driver that supplies a scan output signal to the pixels, and a data driver that supplies a data voltage to the pixels. The data driver converts image data of a digital format, which is received from a timing controller, into a data signal of an analog format according to (e.g., based on) grayscale voltages (e.g., grayscale levels).

The above information disclosed in this Background section is for enhancement of understanding of the background of the present disclosure, and therefore, it may contain information that does not constitute prior art.

SUMMARY

One or more example embodiments of the present disclosure are directed to a display device that compensates for a variation amount (e.g., a change amount or a deviation amount) of a driving voltage through control of a reference voltage. For example, a driving voltage for driving pixels may be provided to a display. When the driving voltage varies (e.g., is changed), a driving current may vary (e.g., may be changed), and thus, an unwanted pattern (e.g., a crosstalk pattern) may be recognized on a display screen. Such a driving voltage may vary (e.g., may be changed) due to a resistance of a line and/or a capacitance between the lines, or may vary (e.g., may be changed) due to a difference of data voltages provided to adjacent pixels.

According to one or more example embodiments of the present disclosure, a display device includes: a display unit including a plurality of pixels configured to display an image according to a driving voltage; a data driver configured to provide data signals to the plurality of pixels; a gamma voltage generator configured to provide a plurality of grayscale voltages to the data driver; and a reference voltage generator configured to provide a first reference voltage and a second reference voltage to the gamma voltage generator. The gamma voltage generator is configured to generate the plurality of grayscale voltages by dividing the first reference voltage and the second reference voltage, and the reference voltage generator is configured to generate a sensing driving voltage by measuring the driving voltage from the display unit, and to generate the first reference voltage and the second reference voltage by utilizing the sensing driving voltage and a reference driving voltage.

In an example embodiment, the display device may further include: a timing controller configured to compare data voltage information of adjacent pixel rows to generate data offset information, and to provide the data offset information to the reference voltage generator, and the reference voltage generator may be configured to control the first reference voltage and the second reference voltage according to the data offset information, the sensing driving voltage, and the reference driving voltage.

In an example embodiment, the timing controller may include: an image processor configured to convert first image data into second image data; memory configured to receive the second image data from the image processor, and to store the second image data; and a comparator configured to receive first data voltage information of a first pixel row of the second image data and second data voltage information of a second pixel row adjacent to the first pixel row of the second image data from the memory, and to output the data offset information according to a difference between the first data voltage information and the second data voltage information.

In an example embodiment, the comparator may include: a first data average calculator configured to divide the first data voltage information into a plurality of first data voltage blocks, and to calculate first average data voltage information by calculating an average of each of the plurality of first data voltage blocks; a second data average calculator configured to divide the second data voltage information into a plurality of second data voltage blocks, and to calculate second average data voltage information by calculating an average of each of the plurality of second data voltage blocks; a first adder configured to add the first average data voltage information to calculate first addition data voltage information; a second adder configured to add the second average data voltage information to calculate second addition data voltage information; and an offset provider configured to generate the data offset information according to a difference between the first addition data voltage information and the second addition data voltage information.

In an example embodiment, a time point at which the memory provides the first data voltage information to the comparator may be earlier than a time point at which the memory provides the first data voltage information to the data driver.

In an example embodiment, the memory may be configured to provide the second data voltage information of the second pixel row to the comparator at a time point at which the memory provides the first data voltage information of the first pixel row to the data driver, and the second pixel row may be a next pixel row that is adjacent to the first pixel row.

In an example embodiment, the reference voltage generator may be configured to control at least one of a time delay, a slew rate, and a gain of the first reference voltage and the second reference voltage according to an offset level of the data offset information, and the offset level of the data offset information may increase as a difference of the data voltage information of the adjacent pixel rows increases, and may decrease as the difference of the data voltage information of the adjacent pixel rows decreases.

In an example embodiment, the reference voltage generator may be configured to control a voltage change time point of the first reference voltage and the second reference voltage to be earlier as the offset level increases.

In an example embodiment, the reference voltage generator may be configured to control the slew rate of the first reference voltage and the second reference voltage to increase as the offset level increases.

In an example embodiment, the reference voltage generator may be configured to control the gain of the first reference voltage and the second reference voltage to increase as the offset level increases.

In an example embodiment, the timing controller may be further configured to: provide distance offset information to the reference voltage generator; and generate the distance offset information according to a separation distance between the plurality of pixels and the data driver, and the reference voltage generator may be configured to control the first reference voltage and the second reference voltage according to the data offset information, the distance offset information, the sensing driving voltage, and the reference driving voltage.

In an example embodiment, the reference voltage generator may be configured to control at least one of a time delay, a slew rate, and a gain of the first reference voltage and the second reference voltage according to an offset level of the distance offset information, and the offset level of the distance offset information may increase as the separation distance increases, and may decrease as the separation distance decreases.

In an example embodiment, the reference voltage generator may include: a first differential amplifier configured to output the first reference voltage according to a difference between the sensing driving voltage and the reference driving voltage; and a second differential amplifier configured to output the second reference voltage according to a difference between the sensing driving voltage and the reference driving voltage.

In an example embodiment, the reference driving voltage may be a target driving voltage for normally driving the plurality of pixels.

According to one or more example embodiments of the present disclosure, a method of driving a display device, includes: generating a sensing driving voltage by measuring a driving voltage supplied to a display unit including a plurality of pixels; generating data offset information by comparing data voltage information of adjacent pixel rows; generating a first reference voltage and a second reference voltage according to the sensing driving voltage, a reference driving voltage, and the data offset information; and generating a plurality of grayscale voltages by dividing the first reference voltage and the second reference voltage.

In an example embodiment, the generating of the first reference voltage and the second reference voltage may include controlling at least one of a time delay, a slew rate, and a gain of the first reference voltage and the second reference voltage according to an offset level of the data offset information, and the offset level may increase as a difference of the data voltage information of adjacent pixel rows increases, and may decrease as the difference of the data voltage information of the adjacent pixel rows decreases.

In an example embodiment, a control time point of the first reference voltage and the second reference voltage may be controlled to be earlier as the offset level increases.

In an example embodiment, the slew rate of the first reference voltage and the second reference voltage may be controlled to increase as the offset level increases.

In an example embodiment, the gain of the first reference voltage and the second reference voltage may be controlled to increase as the offset level increases.

In an example embodiment, the generating of the data offset information may include: dividing first data voltage information of a first pixel row into a plurality of first data voltage blocks; dividing second data voltage information of a second pixel row adjacent to the first pixel row into a plurality of second data voltage blocks; calculating first average data voltage information of each of the first data voltage blocks; calculating second average data voltage information of each of the second data voltage blocks; calculating first addition data voltage information by adding the first average data voltage information; calculating second addition data voltage information by adding the second average data voltage information; and generating the data offset information according to the first addition data voltage information and the second addition data voltage information.

According to one or more example embodiments of the present disclosure, the display device may measure the driving voltage provided to each pixel, and may generate the reference voltages according to (e.g., based on) the measured sensing driving voltage and the previously stored reference driving voltage to compensate for the change amount of the driving voltage. Therefore, display quality of the display device may be improved.

According to one or more example embodiments of the present disclosure, the display device may generate the data offset information by comparing data voltages corresponding to adjacent pixel rows, and may generate the reference voltages according to (e.g., based on) the data offset information, thereby effectively compensating for the change amount of the driving voltage.

According to one or more example embodiments of the present disclosure, the distance offset information may be generated according to the distance between each pixel and the data driver, and the reference voltages may be generated according to (e.g., based on) the distance offset information, thereby effectively compensating for the change amount of the driving voltage.

However, the aspects and features of the present disclosure are not limited to those described above, and various other aspects and features may be described in the following detailed description.

BRIEF DESCRIPTION OF THE DRAWINGS

The above and other aspects and features of the present disclosure will become more apparent to those skilled in the art from the following detailed description of the example embodiments with reference to the accompanying drawings, in which.

DETAILED DESCRIPTION

Figure 1:
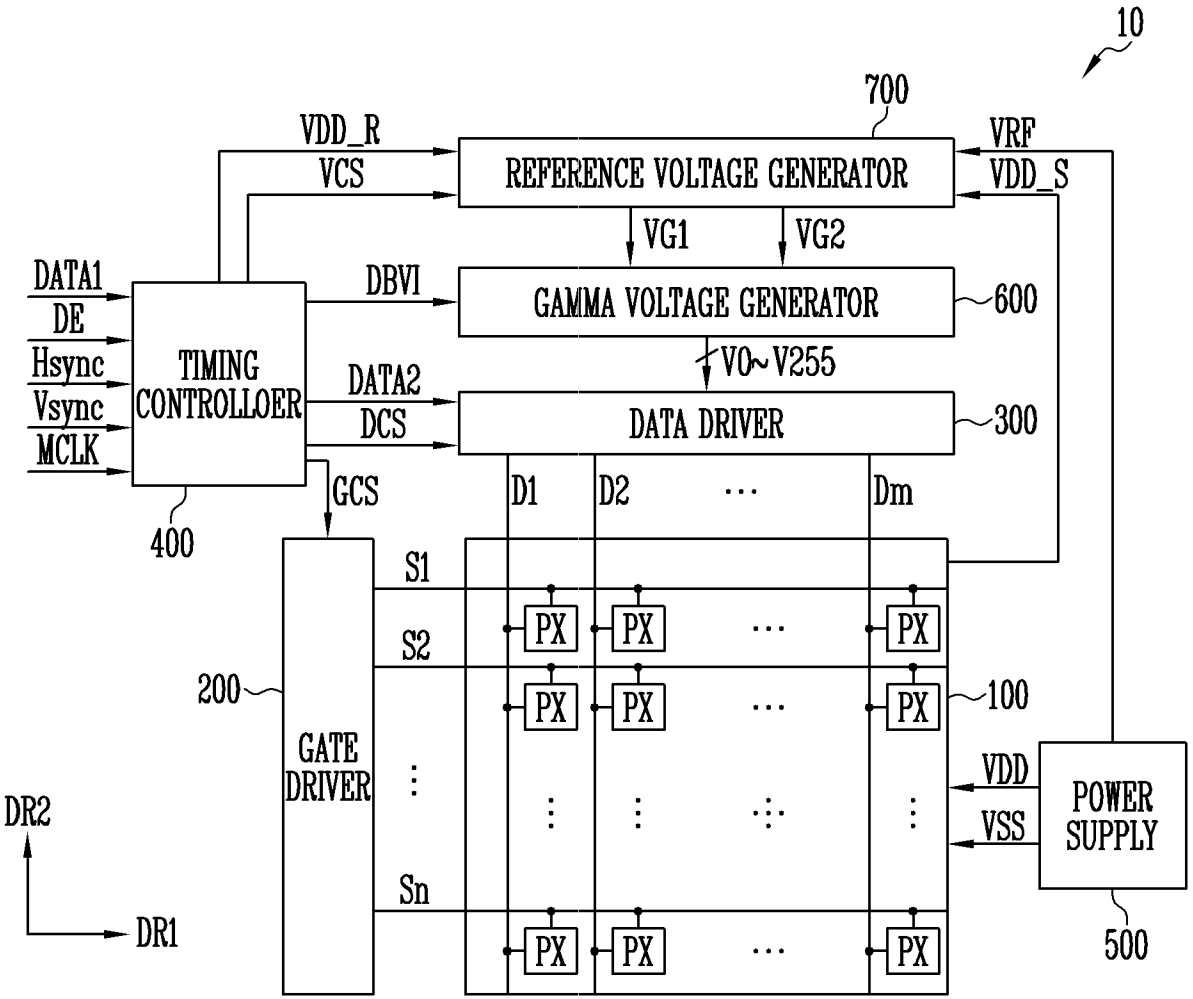
FIG. 1 is a diagram illustrating a display device according to an embodiment of the present disclosure.

Hereinafter, example embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a diagram illustrating a display device according to an embodiment of the present disclosure.

Referring to FIG. 1, the display device 10 according to an embodiment may include a display unit (e.g., a display panel) 100, a gate driver 200, a data driver 300, a timing controller 400, a power supply 500, a gamma voltage generator 600, and a reference voltage generator 700.

The display unit 100 may display an image. For example, the display unit 100 may be implemented as a display panel. The display unit 100 may include various display elements, for example, such as an organic light emitting element (e.g., an organic light emitting diode (OLED)). Hereinafter, for convenience, the display device 10 including the organic light emitting element as the display element will be described in more detail. However, the present disclosure is not limited thereto, and any suitable kinds of display devices, for example, such as a liquid crystal display (LCD) device, an electrophoretic display (EPD) device, an inorganic light emitting display device, and/or the like, may be applied as the display element included in the display device 10.

The display unit 100 may include data lines D1 to Dm (where m is a positive integer), scan lines (or gate lines) S1 to Sn (where n is a positive integer), and pixels PX. The pixels PX may be disposed at (e.g., in or on) an area partitioned by the data lines D1 to Dm and the scan lines S1 to Sn. The pixels PX may be electrically connected to the data lines D1 to Dm and the scan lines S1 to Sn.

For example, the pixel PX positioned at (e.g., in or on) a first row and a first column may be connected to the first data line D1 and the first scan line S1. In another example, the pixel PX positioned at (e.g., in or on) an n-th row and an m-th column may be connected to the m-th data line Dm and the n-th scan line Sn.

However, the pixels PX are not limited thereto. For example, the pixels PX may be connected to scan lines corresponding to adjacent rows (e.g., a scan line corresponding to a previous row of a row including a corresponding pixel PX, and a scan line corresponding to a subsequent row of the row including the corresponding pixel PX). Further, the pixels PX may be electrically connected to a first power line and a second power line to receive a first driving voltage VDD and a second driving voltage VSS. Here, the first driving voltage VDD and the second driving voltage VSS may be voltages used for driving the pixel PX. Hereinafter, the driving voltage used for driving the pixel PX may be refer to as the first driving voltage VDD.

The pixel PX may emit light having a luminance corresponding to a data signal provided through a corresponding data line, in response to a scan signal provided through a corresponding scan line. A more detailed configuration and operation of the pixel PX will be described below with reference to FIGS. 2A and 2B.

The gate driver (or a scan driver) 200 may generate a scan signal (or a gate signal) according to (e.g., based on) a gate control signal GCS, and may provide the scan signal to the scan lines S1 to Sn. Here, the gate control signal GCS may be a signal for controlling an operation of the gate driver 200, and may include a start signal, clock signals, and/or the like. For example, the gate driver 200 may sequentially generate and output a scan signal corresponding to the start signal (e.g., a scan signal having a waveform that is the same as or substantially the same as (or similar to) a waveform of the start signal) using the clock signals. The gate driver 200 may be implemented as a shift register, but the present disclosure is not limited thereto. The gate driver 200 may be formed at (e.g., in or on) one area of the display unit 100 (e.g., one area of the display panel), or may be implemented as an integrated circuit (IC) and may be mounted on a flexible circuit board to be connected to the display unit 100.

The data driver 300 may be implemented as an integrated circuit (e.g., a driving IC), or may be mounted on a flexible circuit board to be connected to the display unit 100. The data driver 300 may generate a data signal according to (e.g., based on) image data DATA2, a data control signal DCS, and grayscale voltages V0 to V255 (or gamma voltages), and may provide the data signal to the data lines D1 to Dm in units of a pixel row (e.g., in a pixel row unit). Here, the data control signal DCS may be a signal for controlling an operation of the data driver 300, and may include a load signal, a start signal, clock signals, and/or the like.

The timing controller 400 may receive input image data DATA1 (e.g., RGB data) and input control signals from the outside (e.g., from a graphics processor). The input image data DATA1 may include grayscale values (e.g., gray levels) corresponding to each pixel PX. The input control signals may include a vertical synchronization signal Vsync, a horizontal synchronization signal Hsync, a main clock signal MCLK, a data enable signal DE, and/or the like.

The timing controller 400 may generate the image data DATA2 according to (e.g., based on) the input image data DATA1, and may generate the gate control signal GCS and the data control signal DCS according to (e.g., based on) the input control signals. The timing controller 400 may provide the gate control signal GCS to the gate driver 200, and may provide the data control signal DCS and the image data DATA2 to the data driver 300.

The power supply 500 may supply the first driving voltage VDD and the second driving voltage VSS to the display unit 100. The first driving voltage VDD may have a value (e.g., a voltage level) higher than that of the second driving voltage VSS. The first driving voltage VDD may be provided to one side of the display unit 100. In this case, because of a resistance of an internal line of the display unit 100 and/or a capacitance generated between lines, the first driving voltage VDD that is provided from the one side of the display unit 100 to an area adjacent to another side facing the one side of the display unit 100 may have a value (e.g., a voltage level) that is less than the value of the first driving voltage VDD that is provided to the one side of the display unit 100. In some embodiments, the power supply 500 may further supply an initialization voltage to the display unit 100.

The gamma voltage generator (e.g., a grayscale voltage generator) 600 may receive a first reference voltage VG1, a second reference voltage VG2, and an input maximum luminance value DBVI. The gamma voltage generator 600 may generate a plurality of grayscale voltages V0 to V255 for a plurality of grayscales according to (e.g., based on) the first reference voltage VG1, the second reference voltage VG2, and the input maximum luminance value DBVI, and may provide the plurality of grayscale voltages V0 to V255 to the data driver 300.

The plurality of grayscale voltages V0 to V255 generated by the gamma voltage generator 600 may be intermediate voltages between the first reference voltage VG1 and the second reference voltage VG2. The plurality of grayscale voltages V0 to V255 may vary in correspondence with the provided first and second reference voltages VG1 and VG2. For example, when the first and second reference voltages VG1 and VG2 increase at a constant rate, the plurality of grayscale voltages V0 to V255 may also increase at the same or substantially the same rate.

In addition, the gamma voltage generator 600 may receive the input maximum luminance value DBVI, and may provide the grayscale voltages V0 to V255 corresponding to the input maximum luminance value DBVI. Hereinafter, for convenience of description, a total of 256 grayscales, for example, from a 0 grayscale level (e.g., a minimum grayscale level) to a 255 grayscale level (e.g., a maximum grayscale level), are described, but the present disclosure is not limited thereto, and the total grayscales may include more grayscale levels when grayscale values exceeding 8 bits are expressed. As used herein, the minimum grayscale level may refer to the darkest grayscale level and the maximum grayscale level may refer to the brightest grayscale level.

A maximum luminance value may be a luminance value of light emitted from the pixels in correspondence with the maximum grayscale level. For example, the maximum luminance value may be a luminance value of white light generated when a pixel forming one dot emits light in correspondence with a 255 grayscale level. A unit of a luminance value may be nit. The maximum luminance value may be manually set by a user's manipulation of the display device 10, or may be automatically set by an algorithm associated with an illuminance sensor. The set maximum luminance value may be expressed as the input maximum luminance value DBVI.

The reference voltage generator 700 may receive a reference driving voltage VDD_R, a compensation selection signal VCS, a reference voltage VRF, a sensing driving voltage VDD_S, and/or the like. The reference voltage generator 700 may generate and/or control the first reference voltage VG1 and the second reference voltage VG2 according to (e.g., based on) the reference driving voltage VDD_R, the compensation selection signal VCS, the reference voltage VRF, the sensing driving voltage VDD_S, and/or the like, and may provide the first reference voltage VG1 and the second reference voltage VG2 to the gamma voltage generator 600. The first reference voltage VG1 may be a value (e.g., a voltage level) higher than that of the first driving voltage VDD, and the second reference voltage VG2 may be a value (e.g., a voltage level) lower than that of the first driving voltage VDD, but the first reference voltage VG1 and the second reference voltage VG2 are not limited thereto. For example, in another embodiment, both of the first reference voltage VG1 and the second reference voltage VG2 may be values (e.g., voltage values) lower than that of the first driving voltage VDD.

The reference driving voltage VDD_R may be a target driving voltage value for normally driving the pixels PX of the display unit 100, and the sensing driving voltage VDD_S may be a voltage value obtained by measuring the first driving voltage VDD that is provided or substantially provided to the display unit 100.

As described above, the first driving voltage VDD generated by the power supply 500 and provided to the display unit 100 may be delayed by a resistance of lines for transferring the first driving voltage VDD to each of the pixels PX, and/or a capacitance between other lines, and thus, a voltage drop may occur. In other words, a driving voltage that is provided to each of the pixels PX may be different from (e.g., may have a different voltage level from that of) the first driving voltage VDD.

Accordingly, the reference voltage generator 700 may determine the driving voltage detected from each of the pixels PX as the sensing driving voltage VDD_S. The reference voltage generator 700 may compare the reference driving voltage VDD_R for normally driving each of the pixels PX with the sensing driving voltage VDD_S to generate the first reference voltage VG1 and the second reference voltage VG2. In other words, the first reference voltage VG1 and the second reference voltage VG2 generated by the reference voltage generator 700 may compensate for a change amount (e.g., an amount of variance or deviation) of the first driving voltage VDD in the display unit 100 to normally drive each of the pixels PX.

Detailed configurations and an operation method of the reference voltage generator 700 will be described in more detail below with reference to FIG. 5.

Still referring to FIG. 1, the timing controller 400 is shown as being implemented independently of (e.g., separately from) the data driver 300, but the present disclosure is not limited thereto. For example, in another embodiment, the timing controller 400 may be implemented as an integrated circuit (e.g., as one integrated circuit) together with (e.g., unitarily with) the data driver 300 (e.g., as a timing controller embedded driver (TED)).

Further, FIG. 1 shows that the gamma voltage generator 600 and the reference voltage generator 700 may be implemented independently of (e.g., separately from) the data driver 300 and/or the timing controller 400, but the present disclosure is not limited thereto. For example, the gamma voltage generator 600 and the reference voltage generator 700 may be implemented as an integrated circuit (e.g., as one integrated circuit) together with (e.g., unitarily with) the data driver 300 and/or the timing controller 400, or the gamma voltage generator 600 and the reference voltage generator 700 may be included in the data driver 300 and/or the timing controller 400 and may be implemented partially or entirely as software.

Figure 2A:
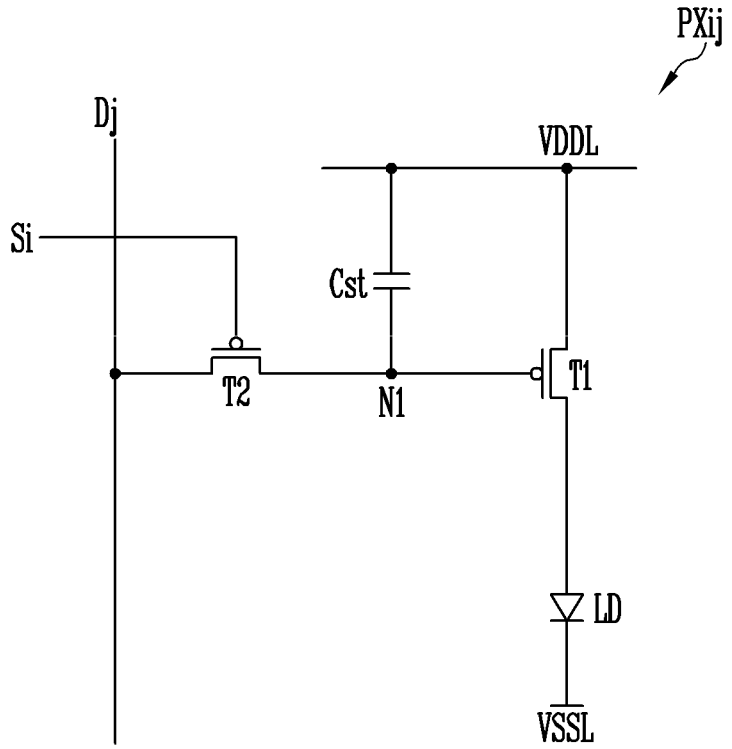
FIG. 2A is a circuit diagram illustrating an example of a pixel included in the display device of FIG. 1.
Figure 2B:
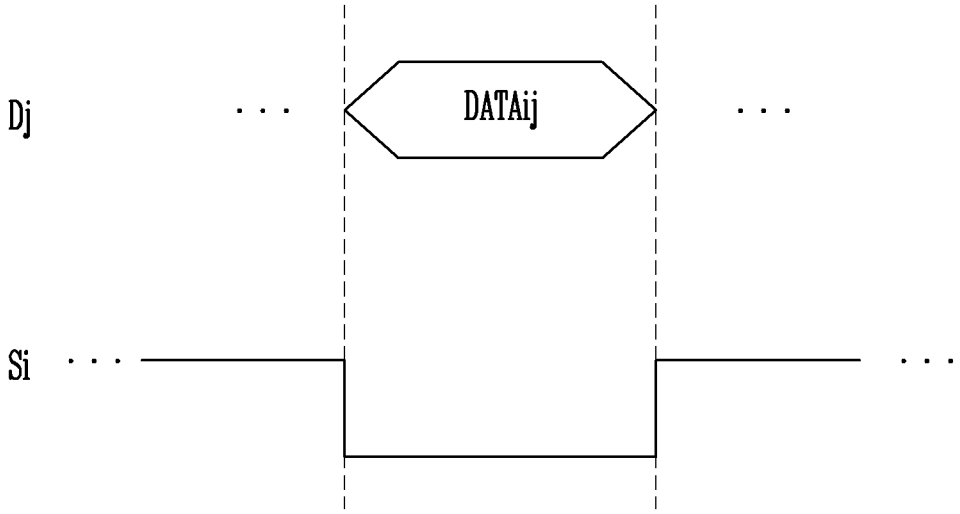
FIG. 2B is a diagram illustrating an exemplary driving method of the pixel of FIG. 2A.

FIG. 2A is a circuit diagram illustrating an example of the pixel included in the display device of FIG. 1. FIG. 2B is a diagram illustrating an exemplary driving method of the pixel of FIG. 2A.

Referring to FIGS. 2A and 2B, the pixel PXij may be connected to a scan line Si and a data line Dj (where i and j are integers). The scan line Si may be any one of the scan lines S1 to Sn of FIG. 1, and the data line Dj may be any one of the data lines D1 to Dm of FIG. 1.

The pixel PXij may include a light emitting element LD, a plurality of transistors T1 and T2, and a storage capacitor Cst.

In the present embodiment, the transistors are shown as P-type transistors, for example, a P-type metal oxide semiconductor (PMOS). However, the present disclosure is not limited thereto, and a pixel circuit may be configured to perform the same or substantially the same functions using N-type transistors, for example, an N-type metal oxide semiconductor (NMOS), as would be known to those skilled in the art.

A first electrode (e.g., an anode electrode) of the light emitting element LD may be connected to a first driving voltage line VDDL through the first transistor T1, and a second electrode (e.g., a cathode electrode) of the light emitting element LD may be connected to a second driving voltage line VSSL. The first driving voltage line VDDL may be a line for providing the first driving voltage VDD of FIG. 1, and the second driving voltage line VSSL may be a line for providing the second driving voltage VSS of FIG. 1.

A first electrode of the first transistor (e.g., a driving transistor) T1 may be connected to the first driving voltage line VDDL, and a second electrode of the first transistor T1 may be connected to the first electrode of the light emitting element LD. A gate electrode of the first transistor T1 may be connected to a first node N1. The first transistor T1 may control an amount of a driving current supplied to the light emitting element LD in correspondence with a voltage of the first node N1.

A first electrode of the second transistor (e.g., a switching transistor) T2 may be connected to the data line Dj, and a second electrode of the second transistor T2 may be connected to the first node N1. A gate electrode of the second transistor T2 may be connected to the scan line Si.

One electrode of the storage capacitor Cst may be connected to the first node N1, and another electrode of the storage capacitor Cst may be connected to the first driving voltage line VDDL. The storage capacitor Cst may be charged with a voltage corresponding to a data signal of one frame supplied to the first node N1, and may maintain or substantially maintain the charged voltage until the data signal of a next frame is supplied.

When a scan signal having a turn-on level (e.g., a low level) is supplied to the gate electrode of the second transistor T2 through the scan line Si, the second transistor T2 may connect the data line Dj and the one electrode of the storage capacitor Cst to each other. Therefore, a voltage value (e.g., a voltage level) corresponding to (e.g., according to) a difference between a data voltage DATAij applied through the data line Dj and the first driving voltage VDD (e.g., see FIG. 1) of the first driving voltage line VDDL may be written to (e.g., may be stored in) the storage capacitor Cst. The data voltage DATAij may correspond to one of the grayscale voltages V0 to V255 of FIG. 1.

The first transistor T1 may allow a driving current (e.g., determined according to the voltage written to the storage capacitor Cst) to flow from the first driving voltage line VDDL to the second driving voltage line VSSL. The light emitting element LD may emit light having a luminance corresponding to an amount of the driving current.

For convenience, FIG. 2A shows a pixel circuit having a relatively simple structure including the second transistor T2 for transferring the data signal into the pixel PXij, the storage capacitor Cst for storing the data signal, and the first transistor T1 for supplying the driving current corresponding to the data signal to the light emitting element LD. However, the present disclosure is not limited thereto, and the structure of the pixel circuit may be variously modified and implemented, as would be known to those skilled in the art. For example, in other embodiments, the pixel circuit may further include various transistors, such as a compensation transistor for compensating for a threshold voltage of the first transistor T1, an initialization transistor for initializing the first node N1 or the anode electrode of the light emitting element LD, and/or a light emission control transistor for controlling a light emission time of the light emitting element LD.

Figure 3:
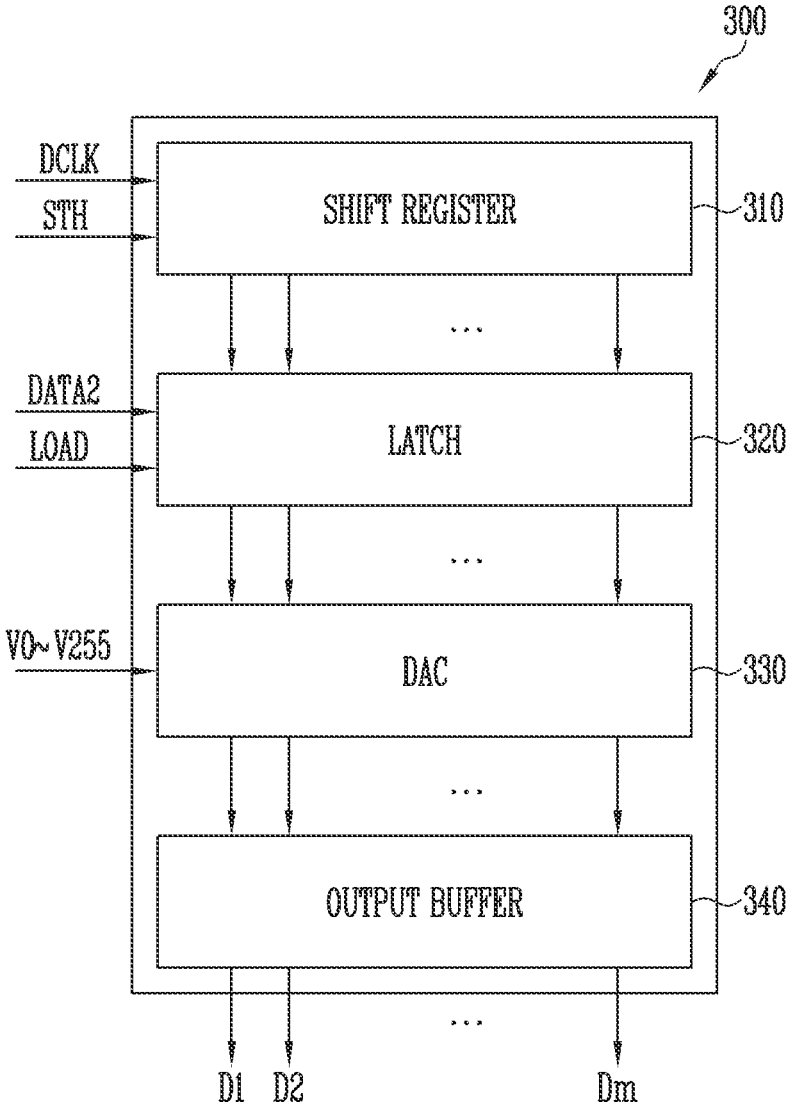
FIG. 3 is a diagram illustrating a data driver included in the display device of FIG. 1.

FIG. 3 is a diagram illustrating a data driver included in the display device of FIG. 1.

Referring to FIG. 3, the data driver 300 may include a shift register 310, a latch 320, a digital-analog converter (DAC) 330, and an output buffer 340.

The shift register 310 may receive a horizontal start signal STH and a data clock signal DCLK from the timing controller 400. The horizontal start signal STH and the data clock signal DCLK may be signals included in the data control signal DCS of FIG. 1 provided by the timing controller 400. The shift register 310 may generate a sampling signal by shifting the horizontal start signal STH in synchronization with the data clock signal DCLK.

The latch 320 may latch the image data DATA2 in response to the sampling signal. The latch 320 may output the latched image data DATA2 in response to a load signal LOAD.

The digital-analog converter 330 may convert the latched image data DATA2 of a digital format into a corresponding data signal of an analog format according to (e.g., based on) the grayscale scale voltages V0 to V255.

The output buffer 340 may output the data signals to the data lines D1 to Dm. In an embodiment, the output buffer 340 may include a voltage follower, and may output the transferred data signal as is. In another embodiment, the output buffer 340 may include an amplifier and may amplify and output the transferred data signals.

FIG. 3 illustrates that the data driver 300 includes the shift register 310, the latch 320, the digital-analog converter 330, and the output buffer 340. However, a structure of the data driver 300 is not limited thereto, and the data driver 300 may include other configurations as would be known to those skilled in the art.

Figure 4:
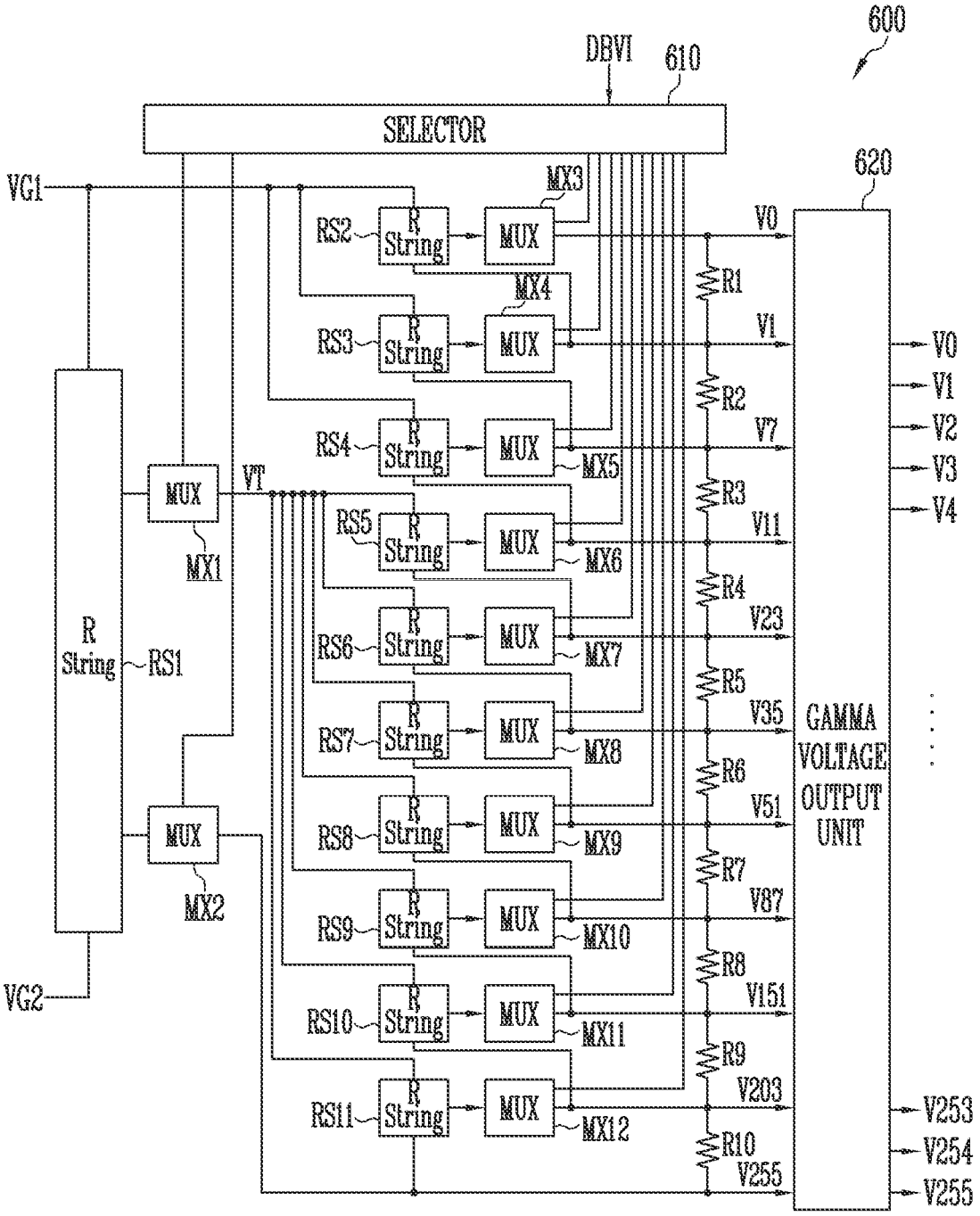
FIG. 4 is a diagram illustrating a gamma voltage generator included in the display device of FIG. 1.

FIG. 4 is a diagram illustrating the gamma voltage generator included in the display device of FIG. 1.

Referring to FIG. 4, the gamma voltage generator 600 may include a selection value provider (SELECTOR) 610, a gamma voltage output unit (e.g., a gamma voltage output circuit) 620, resistor strings (R String) RS1 to RS11, multiplexers (MUX) MX1 to MX12, and resistors R1 to R10.

The selection value provider 610 may provide selection values for the multiplexers MX1 to MX12 according to the input maximum luminance value DBVI. The selection values according to the input maximum luminance value DBVI may be stored in advance in a memory element, for example, such as a register.

The resistor string RS1 may generate intermediate voltages of the first reference voltage VG1 and the second reference voltage VG2. The multiplexer MX1 may select one of the intermediate voltages provided from the resistor string RS1 according to the selection value, and may output a third reference voltage VT. The multiplexer MX2 may select one of the intermediate voltages provided from the resistor string RS1 according to the selection value, and may output the 255 grayscale voltage V255.

The resistor string RS11 may generate intermediate voltages of the third reference voltage VT and the 255 grayscale voltage V255. The multiplexer MX12 may select one of the intermediate voltages provided from the resistor string RS11 according to the selection value, and may output the 203 grayscale voltage V203.

The resistor string RS10 may generate intermediate voltages of the third reference voltage VT and the 203 grayscale voltage V203. The multiplexer MX11 may select one of the intermediate voltages provided from the resistor string RS10 according to the selection value, and may output the 151 grayscale voltage V151.

The resistor string RS9 may generate intermediate voltages of the third reference voltage VT and the 151 grayscale voltage V151. The multiplexer MX10 may select one of the intermediate voltages provided from the resistor string RS9 according to the selection value, and may output the 87 grayscale voltage V87.

The resistor string RS8 may generate intermediate voltages of the third reference voltage VT and the 87 grayscale voltage V87. The multiplexer MX9 may select one of the intermediate voltages provided from the resistor string RS8 according to the selection value, and may output the 51 grayscale voltage V51.

The resistor string RS7 may generate intermediate voltages of the third reference voltage VT and the 51 grayscale voltage V51. The multiplexer MX8 may select one of the intermediate voltages provided from the resistor string RS7 according to the selection value, and may output the 35 grayscale voltage V35.

The resistor string RS6 may generate intermediate voltages of the third reference voltage VT and the 35 grayscale voltage V35. The multiplexer MX7 may select one of the intermediate voltages provided from the resistor string RS6 according to the selection value, and may output the 23 grayscale voltage V23.

The resistor string RS5 may generate intermediate voltages of the third reference voltage VT and the 23 grayscale voltage V23. The multiplexer MX6 may select one of the intermediate voltages provided from the resistor string RS5 according to the selection value, and may output the 11 grayscale voltage V11.

The resistor string RS4 may generate intermediate voltages of the first reference voltage VG1 and the 11 grayscale voltage V11. The multiplexer MX5 may select one of the intermediate voltages provided from the resistor string RS4 according to the selection value, and may output the seventh grayscale voltage V7.

The resistor string RS3 may generate intermediate voltages of the first reference voltage VG1 and the seventh grayscale voltage V7. The multiplexer MX4 may select one of the intermediate voltages provided from the resistor string RS3 according to the selection value, and may output the first grayscale voltage V1.

The resistor string RS2 may generate intermediate voltages of the first reference voltage VG1 and the first grayscale voltage V1. The multiplexer MX3 may select one of the intermediate voltages provided from the resistor string RS2 according to the selection value, and may output the zero grayscale voltage V0.

The above-described 0, 1, 7, 11, 23, 35, 51, 87, 151, 203, and 255 grayscales may be referred to as reference grayscales. In addition, the grayscale voltages V0, V1, V7, V11, V23, V35, V51, V87, V151, V203, and V255 generated from the multiplexers MX2 to MX12 may be referred to as reference grayscale voltages. The number of reference grayscales and a grayscale number corresponding to the reference grayscale may be set differently according to a product.

The gamma voltage output unit 620 may divide the reference grayscale voltages V0, V1, V7, V11, V23, V35, V51, V87, V151, V203, and V255 to generate all of the grayscale voltages V0 to V255. For example, the gamma voltage output unit 620 may divide the reference grayscale voltages V1 and V7 to generate the grayscale voltages V2 to V6.

Figure 5:
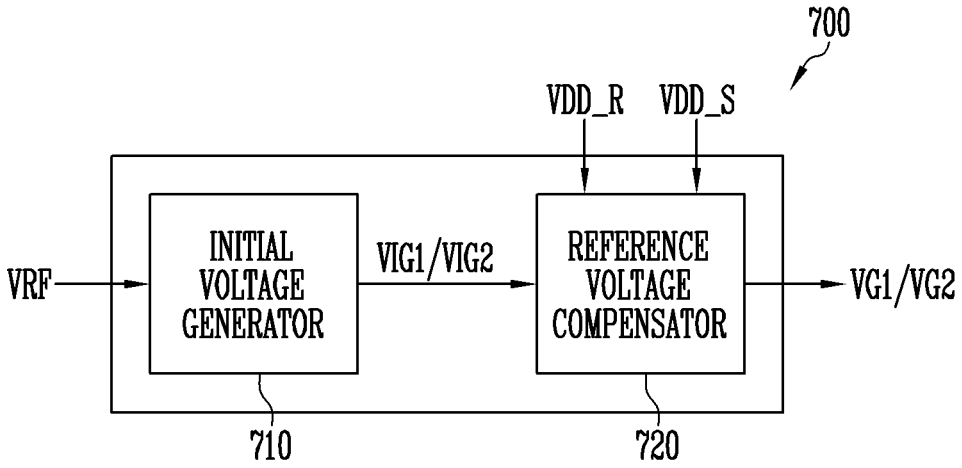
FIG. 5 is a diagram illustrating an example of a reference voltage generator included in the display device of FIG. 1.

FIG. 5 is a diagram illustrating an example of a reference voltage generator included in the display device of FIG. 1.

Referring to FIGS. 1 and 5, the reference voltage generator 700 may include an initial voltage generator 710 and a reference voltage compensator 720.

The initial voltage generator 710 may generate a first initial reference voltage VIG1 and a second initial reference voltage VIG2 according to (e.g., based on) the reference voltage VRF. In an embodiment, the reference voltage VRF may be the same or substantially the same as the first driving voltage VDD, but the present disclosure is not limited thereto.

The first initial reference voltage VIG1 and the second initial reference voltage VIG2 may be voltage values (e.g., voltage levels) determined in a gamma voltage setting process performed during product production. In the gamma voltage setting process, the display device 10 may be connected to a separate test device, instead of the power supply 500, and may receive a test driving voltage from the test device. The display device 10 may determine the first initial reference voltage VIG1 and the second initial reference voltage VIG2 in correspondence with the test driving voltage, and may set initial grayscale voltages according to (e.g., based on) the first initial reference voltage VIG1 and the second initial reference voltage VIG2. For example, in the gamma voltage setting process, the display device 10 may set the initial grayscale voltages so that a luminance according to each of the grayscales of the pixels PX becomes a predetermined gamma curve (e.g., a 2.2 gamma curve) according to (e.g., based on) the first initial reference voltage VIG1 and the second initial reference voltage VIG2.

After the product production, the power supply 500 may be connected to the display device 10 to provide the first driving voltage VDD. A variation (e.g., a deviation) may be generated between the first driving voltage VDD provided from the power supply 500 and the test driving voltage of the test device of the gamma voltage setting process. For example, a resistance of a connector for connecting the display device 10 and the test device to each other during the gamma voltage setting process may be different from the resistance of the connector for connecting the display device 10 and the power supply 500 to each other after the product production.

As the variation (e.g., the deviation) occurs in the driving voltage after the product production, the reference voltage compensator 720 may receive the reference driving voltage VDD_R and the sensing driving voltage VDD_S, and may compensate for the first initial reference voltage VIG1 and the second initial reference voltage VIG2. The reference voltage compensator 720 may generate the first reference voltage VG1 and the second reference voltage VG2 by compensating for the first initial reference voltage VIG1 and the second initial reference voltage VIG2.

The reference voltage compensator 720 will be described in more detail with reference to FIG. 6.

Figure 6:
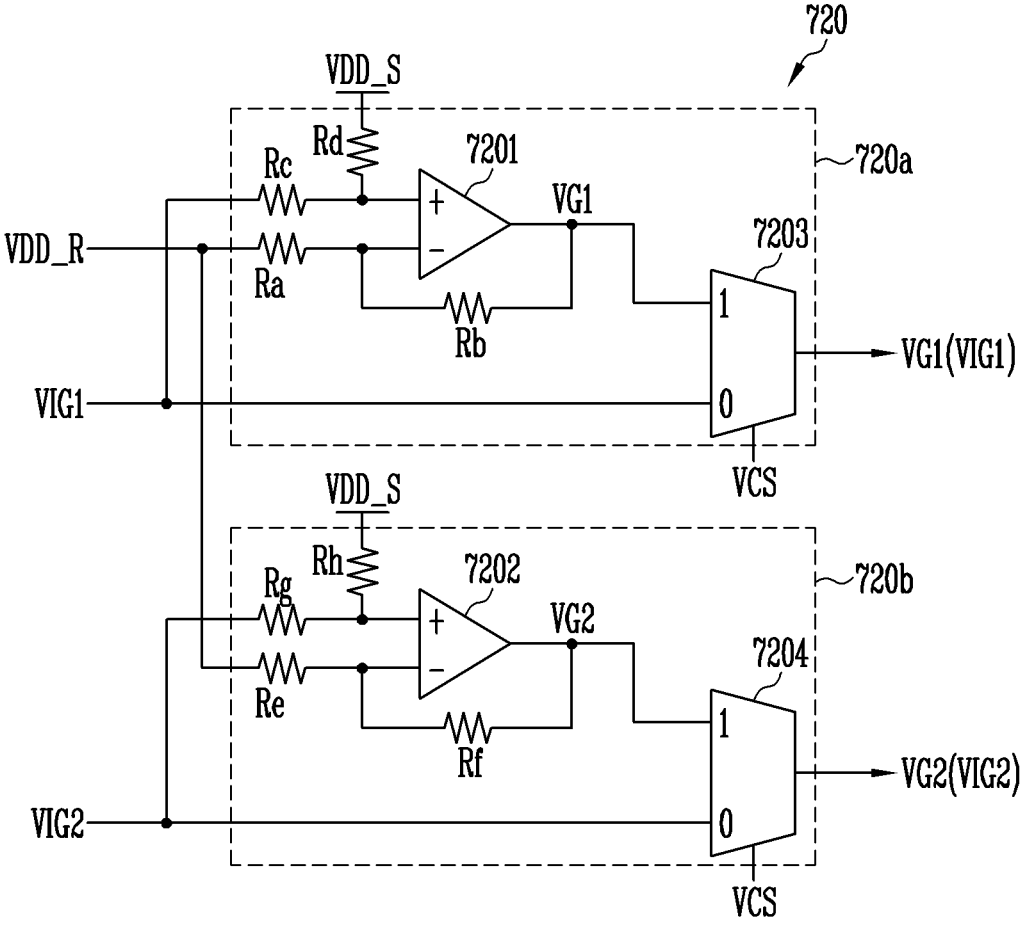
FIG. 6 is a diagram illustrating an example of a reference voltage compensator included in the reference voltage generator of FIG. 5.

FIG. 6 is a diagram illustrating an example of the reference voltage compensator included in the reference voltage generator of FIG. 5.

Referring to FIG. 6, the reference voltage compensator 720 may include a first reference voltage compensator 720*a* and a second reference voltage compensator 720*b*.

The first reference voltage compensator 720*a* may output the first reference voltage VG1 by compensating for the first initial reference voltage VIG1.

The first reference voltage compensator 720*a* may include a first differential amplifier 7201 and a plurality of resistors Ra, Rb, Rc, and Rd.

The first initial reference voltage VIG1 may be applied to a first input terminal (+) of the first differential amplifier 7201 through the resistor Rc, and the sensing driving voltage VDD_S may be applied to the first input terminal (+) of the first differential amplifier 7201 through the resistor Rd. In addition, the reference driving voltage VDD_R may be applied to a second input terminal (−) of the first differential amplifier 7201 through the resistor Ra, and the first reference voltage VG1 may be applied to the second input terminal (−) of the first differential amplifier 7201 through the resistor Rb.

The first reference voltage VG1 may be output as a value proportional to a difference between a voltage of the first input terminal (+) and a voltage of the second input terminal (−) of the first differential amplifier 7201. In other words, the first reference voltage VG1 may be output as a voltage proportional to a value obtained by adding a difference between the sensing driving voltage VDD_S and the reference driving voltage VDD_R to the first initial reference voltage VIG1.

The resistors Ra, Rb, Rc, and Rd of the first reference voltage compensator 720*a* may have the same or substantially the same value (e.g., resistance value) as each other, but the present disclosure is not limited thereto. For example, the resistance values of the resistors Ra, Rb, Rc, and Rd may be different from each other, and thus, a voltage value of the first reference voltage VG1 output through the first differential amplifier 7201 may be adjusted.

The second reference voltage compensator 720*b* may output the second reference voltage VG2 by compensating for the second initial reference voltage VIG2.

The second reference voltage compensator 720*b* may include a second differential amplifier 7202 and a plurality of resistors Re, Rf, Rg, and Rh.

The second initial reference voltage VIG2 may be applied to a first input terminal (+) of the second differential amplifier 7202 through the resistor Rg, and the sensing driving voltage VDD_S may be applied to the first input terminal (+) of the second differential amplifier 7202 through the resistor Rh. In addition, the reference driving voltage VDD_R may be applied to a second input terminal (−) of the second differential amplifier 7202 through the resistor Re, and the second reference voltage VG2 may be applied to the second input terminal (−) of the second differential amplifier 7202 through the resistor Rf.

Accordingly, the second reference voltage VG2 may be output as a value proportional to a difference between a voltage of the first input terminal (+) and a voltage of the second input terminal (−) of the second differential amplifier 7202. In other words, the second reference voltage VG2 may be output as a voltage proportional to a value obtained by adding a difference between the sensing driving voltage VDD_S and the reference driving voltage VDD_R to the second initial reference voltage VIG2.

The resistors Re, Rf, Rg, and Rh of the second reference voltage compensator 720*a* may have the same or substantially the same value (e.g., resistance value) as each other, but the present disclosure is not limited thereto. For example, the resistance values of the resistors Re, Rf, Rg, and Rh may be different from each other, and thus, a voltage value of the second reference voltage VG2 output through the second differential amplifier 7202 may be adjusted.

The first reference voltage compensator 720*a* and the second reference voltage compensator 720*b* may further include a first selector 7203 and a second selector 7204, respectively. According to the compensation selection signal VCS, the first selector 7203 may select and output one of the first initial reference voltage VIG1 and the first reference voltage VG1, and the second selector 7204 may select and output one of the second initial reference voltage VIG2 and the second reference voltage VG2. The compensation selection signal VCS provided to the first selector 7203 and the second selector 7204 may be the same signal. Therefore, the reference voltage compensator 720 may output the first reference voltage VG1 and the second reference voltage VG2 together, or may output the first initial reference voltage VIG1 and the second initial reference voltage VIG2 together.

A structure of the reference voltage compensator 720 shown in FIG. 6 may be an example of one of various suitable structures, and thus, the reference voltage compensator 720 is not limited to the structure shown in FIG. 6.

As illustrated in FIG. 2A, the driving current amount flowing through the light emitting element LD may be determined by the first driving voltage VDD connected to the first electrode of the first transistor T1 and the data voltage DATAij applied through the data line Dj connected to the gate electrode of the first transistor T1 through the second transistor T2. When the first driving voltage VDD varies (e.g., is changed or deviates) due to various causes, for example, such as a line resistance and/or a capacitance between lines, an intended driving current may not flow through the light emitting element LD, and thus, an unwanted pattern may be recognized by the display device.

The reference voltage generator 700 of the display device 10 may generate the first reference voltage VG1 and the second reference voltage VG2 by reflecting a difference between the sensing driving voltage VDD_S obtained by measuring the first driving voltage VDD provided to each of the pixels PX and the driving voltages VDD_R for the normal operation of each of the pixels PX. The grayscale voltages V0 to V255 may be generated according to (e.g., based on) the first reference voltage VG1 and the second reference voltage VG2, and data signals may be generated according to (e.g., based on) the grayscale voltages V0 to V255. In other words, a change amount (e.g., a variance amount or a deviation amount) of the first driving voltage VDD may be compensated through the first reference voltage VG1 and the second reference voltage VG2, and display quality of the display device may be improved.

Hereinafter, another embodiment of the display device will be described. In the following description of one or more embodiments, the same or substantially the same configuration and/or elements as those of one or more of the previously described embodiments may be denoted by the same reference symbols, and thus, redundant description thereof may be simplified or may not be repeated, and differences thereof may be mainly described.

One or more embodiments of FIGS. 7 to 14 may be different from one or more of the above-described embodiments in that a reference voltage generator may further receive data offset information from a timing controller, and may generate first and second reference voltages according to (e.g., based on) the data offset information.

Figure 7:
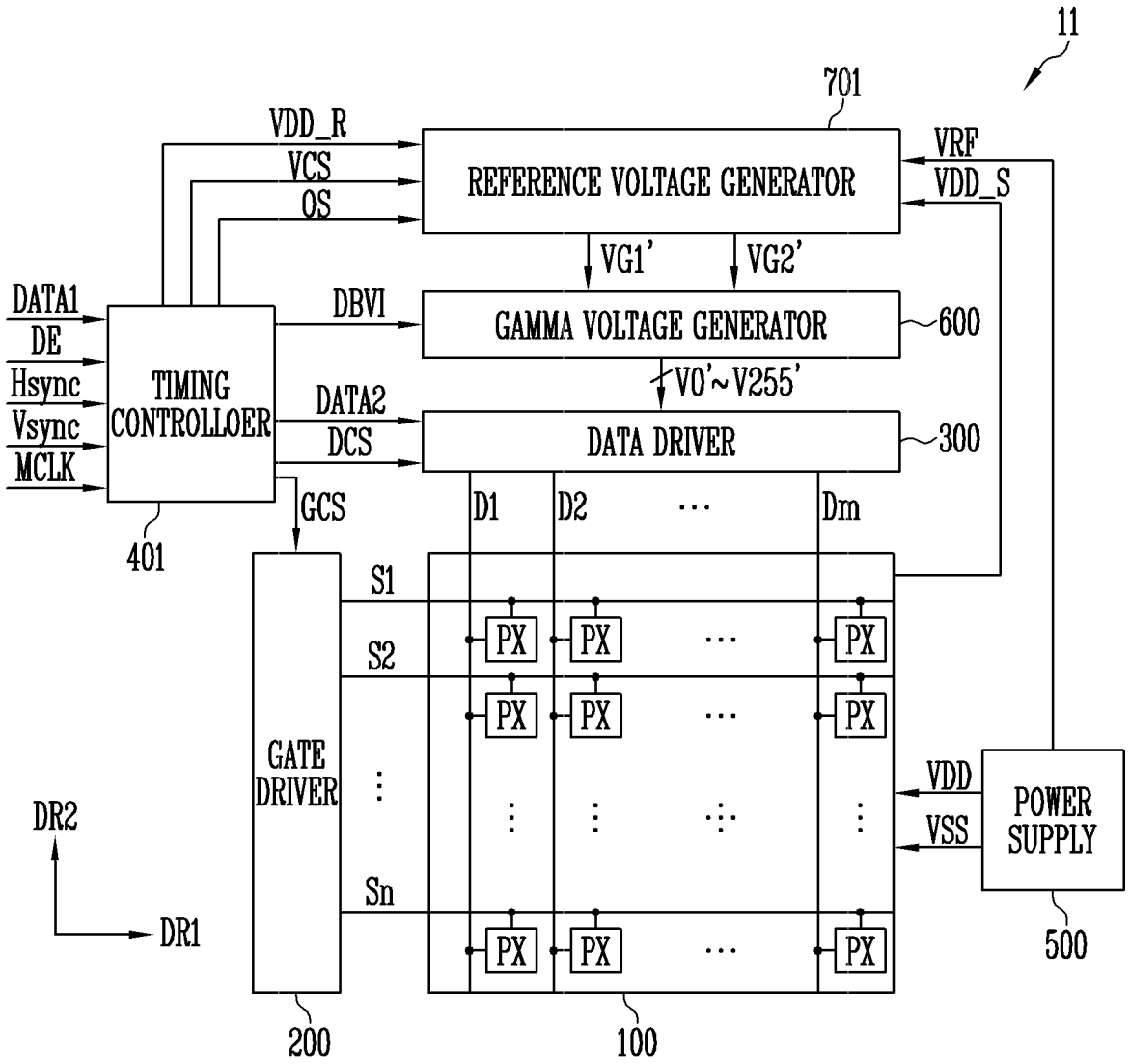
FIG. 7 is a diagram illustrating a display device according to another embodiment of the present disclosure.

FIG. 7 is a diagram illustrating a display device according to another embodiment of the present disclosure.

Referring to FIG. 7, the timing controller 401 of the display device 11 may further provide the data offset information OS to the reference voltage generator 701. The data offset information OS may be information obtained by comparing data voltage values of adjacent pixel rows.

The reference voltage generator 701 may receive the data offset information OS, and may generate the first reference voltage VG1' and the second reference voltage VG2' according to (e.g., based on) the data offset information OS.

The gamma voltage generator 600 may generate grayscale voltages V0' to V255' according to (e.g., based on) the first reference voltage VG1' and the second reference voltage VG2'. The data driver 300 may generate the data signals according to (e.g., based on) the grayscale voltages V0' to V255', and may provide the data signals to the data lines D1 to Dm in units of a pixel row (e.g., a pixel row unit).

Figure 8:
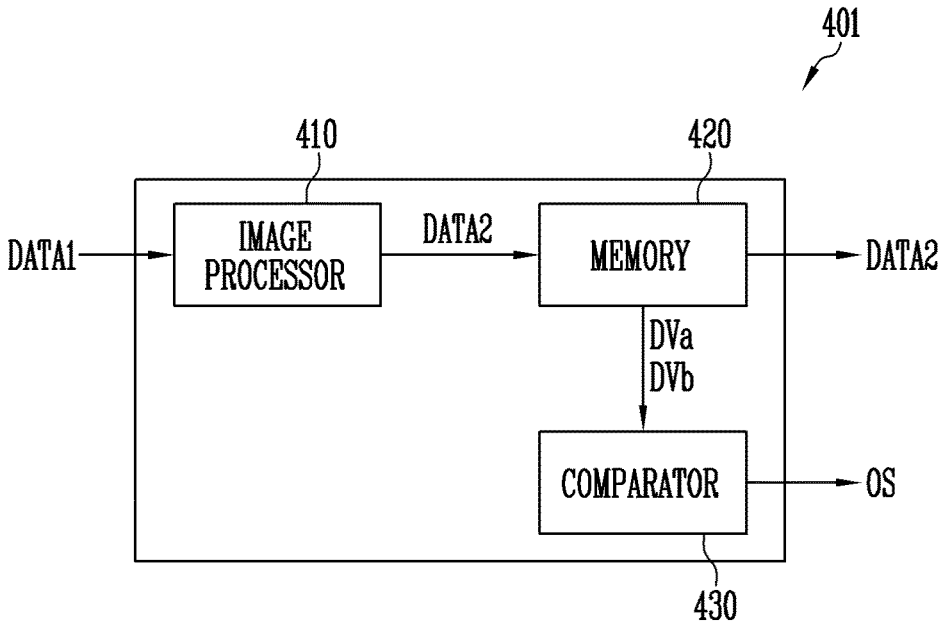
FIG. 8 is a diagram illustrating a timing controller included in the display device of FIG. 7.

FIG. 8 is a diagram illustrating the timing controller included in the display device of FIG. 7.

Referring to FIGS. 7 and 8, the timing controller 401 may include an image processor 410, memory 420, and a comparator 430.

The image processor 410 may convert the input image data DATA1 into the image data DATA2. The image data DATA2 may be data obtained by converting the input image data DATA1 to correspond to the pixel arrangement of the display unit 100. The image data DATA2 may include a plurality of portions (e.g., pieces or sections) of data voltage information. The data voltage information may include grayscale information of each of the data signals provided to the data lines D1 to Dm in units of a pixel row (e.g., in a pixel row unit). For example, the data voltage information may include (e.g., may be) grayscale information of each of the pixel rows.

The memory 420 may receive the image data DATA2 from the image processor 410, and may store (e.g., may temporarily store) the image data DATA2. In an embodiment, the memory 420 may sequentially receive the plurality of portions of the data voltage information from the image processor 410 in an order of the pixel rows.

The memory 420 may provide the stored image data DATA2 to the data driver 300. For example, the memory 420 may sequentially provide the plurality of portions of the data voltage information to the data driver 300.

In addition, the memory 420 may provide the stored image data DATA2 to the comparator 430, and may sequentially provide the data voltage information of the pixel rows. For example, the image data DATA2 provided to the comparator 430 from the memory 420 may include first data voltage information DVa and second data voltage information DVb. The first data voltage information DVa may include (e.g., may be) data voltage information corresponding to a first pixel row from among the pixels PX arranged at (e.g., in or on) the display unit 100, and the second data voltage information DVb may include (e.g., may be) data voltage information corresponding to a second pixel row adjacent to the first pixel row. In other words, the first data voltage information DVa and the second data voltage information DVb may include (e.g., may be) data corresponding to adjacent pixel rows. Here, the first pixel row may be an arbitrary pixel row from among the pixel rows of the display unit, and the second pixel row (e.g., a next pixel row) may be a pixel row positioned next to (e.g., adjacent to) the first pixel row, but the present disclosure is not limited thereto.

The memory 420 may provide the image data DATA2 to the data driver 300 and the comparator 430 in the units of the pixel row (e.g., in the pixel row unit). In addition, the memory 420 may sequentially provide the plurality of portions of the data voltage information. The data voltage information provided by the memory 420 to the comparator 430 and the data voltage information provided by the memory 420 to the data driver 300 concurrently (e.g., simultaneously or at the same time) may be data voltage information of different pixel rows. For example, the pixel row of the data voltage information (e.g., the second data voltage information DVb) provided by the memory 420 to the comparator 430 may correspond to a next pixel row that is adjacent to the pixel row corresponding to the data voltage information (e.g., the first data voltage information DVa) provided by the memory 420 to the data driver 300 concurrently (e.g., simultaneously or at the same time).

As described above, when the first data voltage information DVa corresponds to grayscales (e.g., grayscale levels) of the first pixel row, and the second data voltage information DVb corresponds to the grayscales (e.g., the grayscale levels) of the second pixel row that is adjacent to (e.g., the next pixel row of) the first pixel row, a time point at which the first data voltage information DVa is provided to the comparator 430 may be earlier than a time point at which the first data voltage information DVa is provided to the data driver 300. In addition, the memory 420 may provide the second data voltage information DVb to the comparator 430 at a time point at which the first data voltage information DVa is provided to the data driver 300.

The comparator 430 may generate the data offset information OS according to (e.g., based on) a difference between the first data voltage information DVa and the second data voltage information DVb. As described above, the data offset information OS may be information obtained by comparing the first data voltage information DVa and the second data voltage information DVb. The comparator 430 will be described in more detail with reference to FIG. 9 in relation to a process of generating the data offset information OS of the comparator 430.

Figure 9:
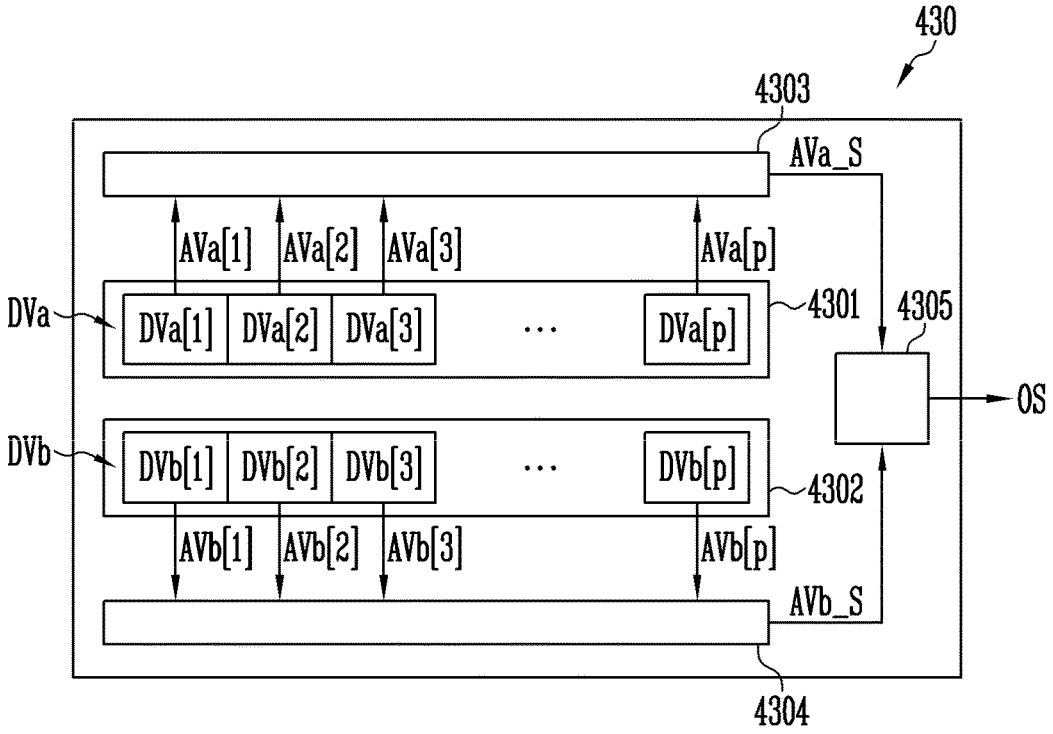
FIG. 9 is a diagram illustrating a comparator included in the timing controller of FIG. 8.

FIG. 9 is a diagram illustrating the comparator included in the timing controller of FIG. 8.

Referring to FIG. 9, the comparator 430 may include first and second data average units (e.g., first and second data average calculators) 4301 and 4302, first and second adders 4303 and 4304, and an offset provider 4305.

The first data voltage information DVa may be input to the first data average unit 4301, and the second data voltage information DVb may be input to the second data average unit 4302.

The first data average unit 4301 may divide the input first data voltage information DVa into p first data voltage blocks (e.g., first blocks) DVa[1] to DVa[p] (where p is a natural number greater than or equal to one). The first data voltage blocks DVa[1] to DVa[p] may have the same or substantially the same size as each other, but the present disclosure is not limited thereto.

For example, the firstly positioned first data voltage block (e.g., a first-first data voltage block) DVa[1] may include (e.g., may be) blocks including grayscale values of each of k pixels connected to first to k-th data lines (where k is a natural number greater than or equal to one) of the first pixel row, the next positioned first data voltage block (e.g., a first-second data voltage block) DVa[2] that is adjacent to the firstly positioned data voltage block DVa[1] may include (e.g., may be) blocks including grayscale values of each of k pixels connected to (k+1)-th to 2k data lines of the first pixel row, and so on.

In an embodiment, the first data voltage information DVa may be divided into a range of 3 to 64 blocks, for example, the first data voltage information DVa may be divided into 7 or more blocks, but the present disclosure is not limited thereto.

The first data average unit 4301 may calculate an average value of the data voltage information included in each of the first data voltage blocks DVa[1] to DVa[p]. For example, the first data average unit 4301 may calculate an average value of the data voltage information of each of the first data voltage blocks DVa[1] to DVa[p] to calculate first average data voltage information AVa[1] to AVa[p]) (e.g., first average grayscale information).

The first data average unit 4301 may provide the calculated first average data voltage information AVa[1] to AVa[p] to the first adder 4303.

The first adder 4303 may calculate first addition data voltage information AVa_S (e.g., first addition grayscale information) by adding the provided first average data voltage information AVa[1] to AVa[p], and may transfer the first addition data voltage information AVa_S to the offset provider 4305.

The second data average unit 4302 may divide the input second data voltage information DVb into the same number of blocks as that of the first data voltage information DVa, and the second data voltage information DVb may have the same or substantially the same size as that of the first data voltage information DVa. In other words, the second data voltage information DVb may be divided into p second data voltage blocks (e.g., second blocks) DVb[1] to DVb[p].

The second data average unit 4302 may calculate an average value of the data voltage information included in each of the second data voltage blocks DVb[1] to DVb[p]. For example, the second data average unit 4302 may calculate an average value of the data voltage information of each of the second data voltage blocks DVb[1] to DVb[p] to calculate the second average data voltage information AVb [1] to AVb[p] (e.g., second average grayscale information).

The second data average unit 4302 may provide the calculated second average data voltage information AVb[1] to AVb[p] to the second adder 4304.

The second adder 4304 may calculate second addition data voltage information AVb_S (e.g., second addition grayscale information) by adding the provided second average data voltage information AVb[1] to AVb[p], and may transfer the second addition data voltage information AVb_S to the offset provider 4305.

The offset provider 4305 may generate the data offset information OS by comparing the first addition data voltage information AVa_S with the second addition data voltage information AVb_S. For example, the offset provider 4305 may generate the data offset information OS according to (e.g., based on) a difference between the first addition data voltage information AVa_S and the second addition data voltage information AVb_S.

An offset level of the data offset information OS may be determined according to the difference between the first addition data voltage information AVa_S and the second addition data voltage information AVb_S. For example, as the difference between the first addition data voltage information AVa_S and the second addition data voltage information AVb_S increases, the offset level of the data offset information OS may increase. Similarly, as the difference between the first addition data voltage information AVa_S and the second addition data voltage information AVb_S decreases, the offset level of the data offset information OS may decrease.

In more detail, the offset provider 4305 may store a first difference value corresponding to a difference between a data voltage at a maximum luminance light emission and a data voltage at a non-light emission. The first difference value may be a value set during a production process of the display device. In addition, the offset provider 4305 may calculate a second difference value corresponding to a difference between a data voltage according to the first addition data voltage information AVa_S and a data voltage according to the second addition data voltage information AVb_S. The offset provider 4305 may generate the data offset information OS by comparing the previously stored first difference value and the second difference value calculated according to (e.g., based on) the difference between the first addition data voltage information AVa_S and the second addition data voltage information AVb_S.

In other words, the offset provider 4305 may determine that a variation of the data voltage decreases, and may set the offset level of the data offset information OS to be decreased as the difference between the first difference value and the second difference value increases. In addition, the offset provider 4305 may determine that the variation of the data voltage increases, and may set the offset level of the data offset information OS to be increased as the difference between the first difference value and the second difference value decreases.

As the variation of data voltages between adjacent pixel rows increases, a variation of the driving voltage may increase, and thus, more compensation may be desired for the reference voltages. In other words, the offset provider 4305 may set the offset level to be increased so that the compensation of the reference voltages may be appropriately performed as the variation of the data voltages between the adjacent pixel rows increases.

The offset level of the data offset information OS may be determined as needed or desired, and may be divided into eight offset levels and expressed as three bits of data. However, the offset level of the data offset information OS is not limited thereto, and may be divided into more than eight levels and expressed as four or more bits of data.

Figure 10:
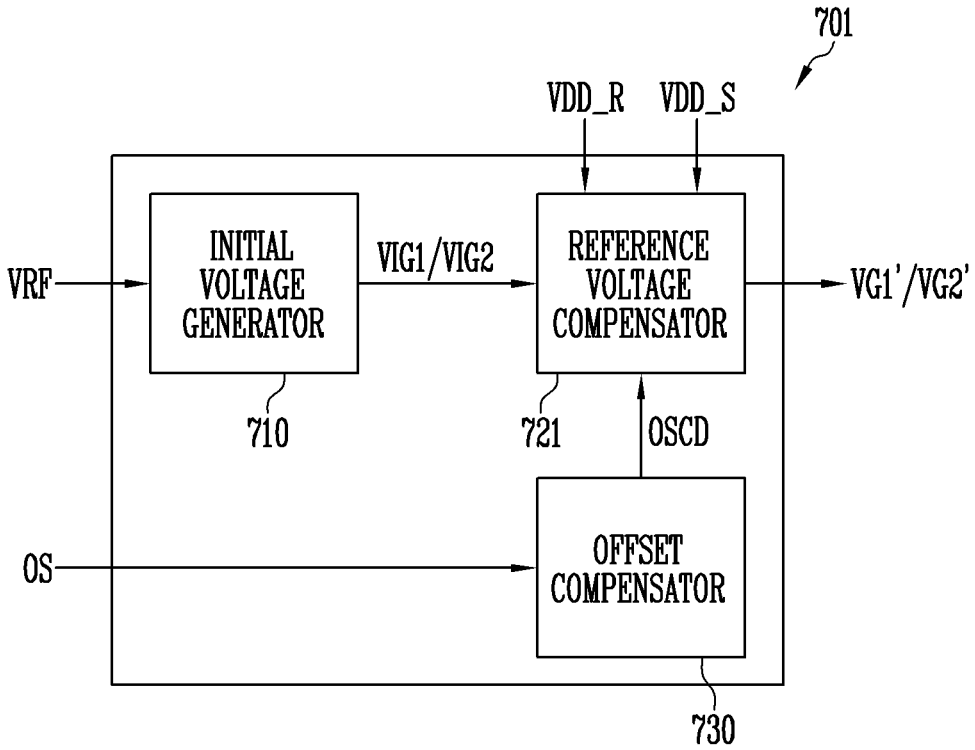
FIG. 10 is a diagram illustrating a reference voltage generator included in the display device of FIG. 7.

FIG. 10 is a diagram illustrating the reference voltage generator included in the display device of FIG. 7.

Referring to FIG. 10, the reference voltage generator 701 may include an initial voltage generator 710, a reference voltage compensator 721, and an offset compensator 730.

The reference voltage generator 701 of FIG. 10 may be different from the reference voltage generator 700 of FIG. 5 in that the reference voltage generator 701 of FIG. 10 may further include the offset compensator 730. In other words, the initial voltage generator 710 and the reference voltage compensator 721 of FIG. 10 may be the same or substantially the same as (or similar to) those of FIG. 5, and thus, redundant description thereof may not be repeated.

The offset compensator 730 may receive the data offset information OS, and may generate offset compensation data OSCD according to (e.g., based on) the data offset information OS. The offset compensation data OSCD may include information corresponding to compensation values determined according to the data offset information OS. The offset compensator 730 may include a plurality of compensators, and may determine compensation values through the respective compensators.

The reference voltage compensator 721 may further receive the offset compensation information OSCD from the offset compensator 730, and may generate the first reference voltage VG1' and the second reference voltage VG2' according to (e.g., based on) the first and second initial reference voltages VIG1 and VIG2, the reference driving voltage VDD_R, the sensing driving VDD_S, and the offset compensation data OSCD.

Hereinafter, the offset compensator 730 included in the reference voltage generator 701 will be described in more detail with reference to FIGS. 11 to 14.

Figure 11:
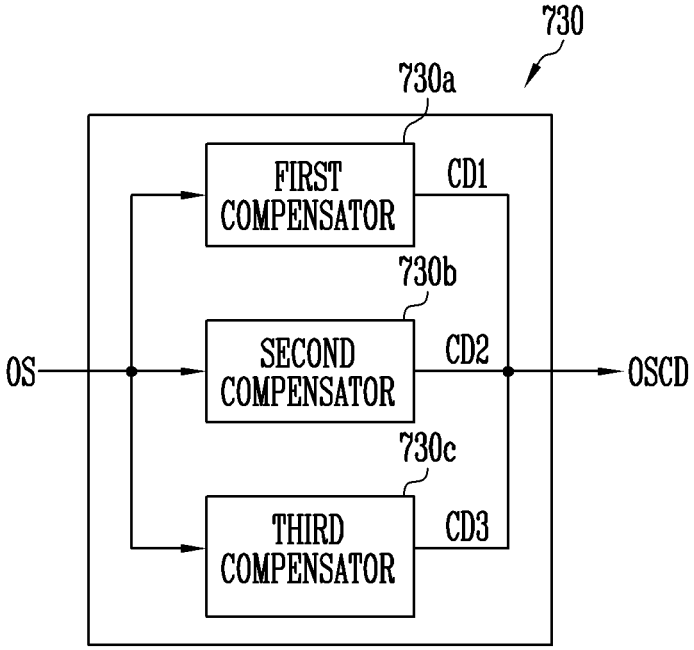
FIG. 11 is a diagram illustrating an offset compensator included in the reference voltage generator of FIG. 10.
Figure 12:
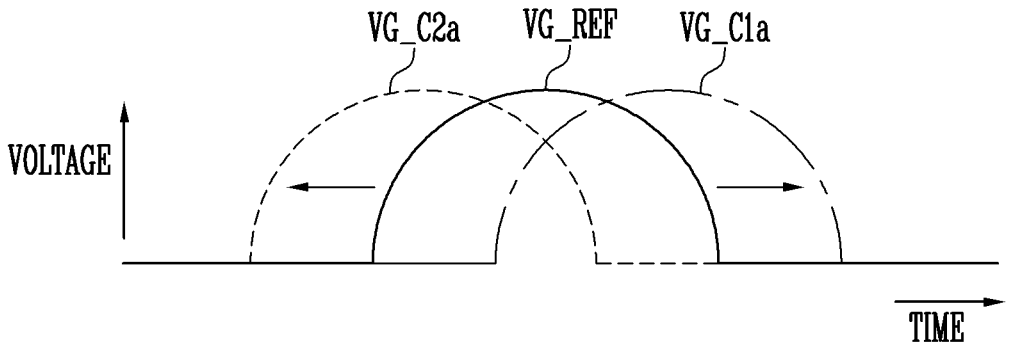
FIG. 12 is a diagram illustrating an example of a time delay compensation by a first compensator of FIG. 11.
Figure 13:
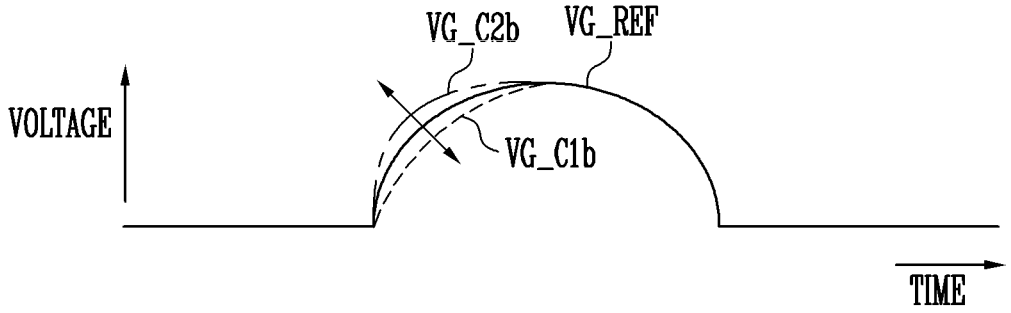
FIG. 13 is a diagram illustrating an example of a slew rate compensation by a second compensator of FIG. 11.
Figure 14:
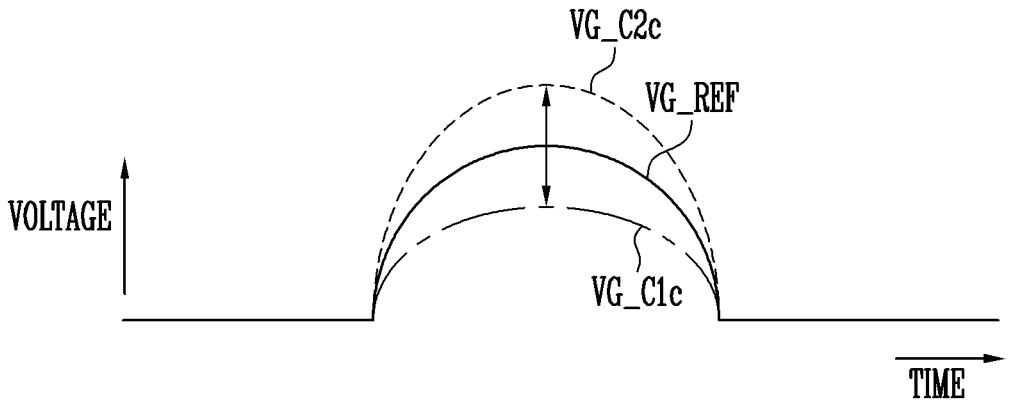
FIG. 14 is a diagram illustrating an example of a gain compensation by a third compensator of FIG. 11.

FIG. 11 is a diagram illustrating the offset compensator included in the reference voltage generator of FIG. 10. FIG. 12 is a diagram illustrating an example of a time delay compensation by a first compensator of FIG. 11. FIG. 13 is a diagram illustrating an example of a slew rate compensation by a second compensator of FIG. 11. FIG. 14 is a diagram illustrating an example of a gain compensation by a third compensator of FIG. 11.

Referring to FIGS. 11 to 14, the offset compensator 730 may include a plurality of compensators 730*a*, 730*b*, and 730*c*. For example, the plurality of compensators 730*a*, 730*b*, and 730*c* may include the first compensator 730*a*, the second compensator 730*b*, and the third compensator 730*c*. The compensators 730*a*, 730*b*, and 730*c* may determine a compensation degree (e.g., a compensation amount) according to the offset level of the data offset information OS.

The first compensator 730*a* may compensate for a time delay of the reference voltages VG1' and VG2'. For example, the first compensator 730*a* may include (e.g., may be) a time delay compensator.

The first compensator 730*a* may receive the data offset information OS, and may generate first compensation data CD1 (e.g., time delay compensation data) corresponding thereto. For example, the first compensator 730*a* may generate the first compensation data CD1 by referring to a look-up table in which time delay compensation values are determined in correspondence with the offset levels of the data offset information OS, respectively. A time delay compensation level of the first compensation data CD1 may be determined in correspondence with the offset level of the data offset information OS.

For example, as shown in FIG. 12, a control time point (e.g., a voltage change time point) of a time delay compensation before a reference voltage VG_REF may be different from a control time point of a time delay compensation after first and second compensated reference voltages VG_C1*a* and VG_C2*a*. Here, the first compensated reference voltage VG_C1*a* may be a reference voltage that is controlled at a later time point as compared with the compensation before the reference voltage VG_REF. In addition, the second compensated reference voltage VG_C2*a* may be a reference voltage that is controlled at an earlier time point as compared with the compensation before the reference voltage VG_REF.

As the offset level of the data offset information OS decreases, the reference voltage may be compensated towards the first compensated reference voltage VG_C1*a*, and thus, the control time point may be delayed. As the offset level of the data offset information OS increases, the reference voltage may be compensated towards the second compensated reference voltage VG_C2*a*, and thus, the control time point may be earlier. However, the present disclosure is not limited thereto.

The second compensator 730*b* may compensate for the slew rate of the reference voltages VG1' and VG2'. For example, the second compensator 730*b* may include (e.g., may be) a slew rate compensator.

The second compensator 730*b* may receive the data offset information OS, and may generate second compensation data CD2 (e.g., slew rate compensation data) corresponding thereto. For example, the second compensator 730*b* may generate the second compensation data CD2 by referring to a look-up table in which slew rate compensation values are determined in correspondence with the offset levels of the data offset information OS, respectively. A slew rate compensation level of the second compensation data CD2 may be determined in correspondence with the slew rate compensation values of the offset level of the data offset information OS.

For example, as shown in FIG. 13, a slew rate (or a rising slew rate) of a slew rate compensation before the reference voltage VG_REF may be different from a slew rate of a slew rate compensation after first and second compensated reference voltages VG_C1*b* and VG_C2*b*. Here, the first compensated reference voltage VG_C1*b* may be a reference voltage having a slew rate that is less than that of the compensation before the reference voltage VG_REF. In addition, the second compensated reference voltage VG_C2*b* may be a reference voltage having a slew rate that is greater than that of the compensation before the reference voltage VG_REF.

As the offset level of the data offset information OS decreases, the reference voltage may be compensated towards the first compensated reference voltage VG_C1*b* of which the slew rate is small. As the offset level of the data offset information OS increases, the reference voltage may be compensated towards the second compensated reference voltage VG_C2*b* of which the slew rate is large. However, the present disclosure is not limited thereto.

The third compensator 730*c* may compensate for the gain of the reference voltages VG1' and VG2'. For example, the third compensator 730*c* may include (e.g., may be) a gain compensator.

The third compensator 730*c* may receive the data offset information OS, and may generate third compensation data CD3 (e.g., gain compensation data) corresponding thereto. For example, the third compensator 730*c* may generate the third compensation data CD3 by referring to a look-up table in which gain compensation values are determined in correspondence with the offset levels of the data offset information OS, respectively. A gain compensation level of the third compensation data CD3 may be determined in correspondence with the offset level of the data offset information OS.

For example, as shown in FIG. 14, a gain of a gain compensation before the reference voltage VG_REF may be different from a gain of gain compensation after first and second compensated reference voltages VG_C1*c* and VG_C2*c*. Here, the first compensated reference voltage VG_C1*c* may be a reference voltage having a gain that is less than that of the compensation before the reference voltage VG_REF. In addition, the second compensated reference voltage VG_C2*c* may be a reference voltage having a gain that is greater than that of the compensation before the reference voltage VG_REF.

As the offset level of the data offset information OS decreases, the reference voltage may be compensated towards the first compensated reference voltage VG_C1*c* of which the gain is small. As the offset level of the data offset information OS increases, the reference voltage may be compensated towards the second compensated reference voltage VG_C2*c* of which the gain is large. However, the present disclosure is not limited thereto.

As described above, the compensators 730*a*, 730*b*, and 730*c* may generate the first to third compensation data CD1, CD2, and CD3 using the lookup table corresponding to the offset level of the data offset information OS. However, a method of generating the first to third compensation data CD1, CD2, and CD3 is not limited thereto, and the first to third compensation data CD1, CD2, and CD3 may be generated by including a separate operation device.

The first to third compensation data CD1, CD2, and CD3 output from the compensators 730*a*, 730*b*, and 730*c* may be output as the offset compensation data OSCD.

As described above, the first driving voltage VDD applied to each of the pixels PX may vary (e.g., may greatly vary) according to a difference of the data voltages between adjacent pixel rows. Therefore, the display device 11 according to the present embodiment may generate the difference between the data voltages of the adjacent pixel rows as the data offset information OS, and may generate the reference voltages VG1' and VG2' by further reflecting the data offset information OS. According to the compensation of the reference voltages VG1' and VG2', the data signal (e.g., the data voltage) provided to each of the pixels PX may also be compensated. Therefore, even though the first driving voltage VDD provided to each pixel PX may vary (e.g., may change or deviate), the driving current amount flowing through the light emitting element LD of FIG. 2A may be maintained or substantially maintained as intended or desired, and thus, the display quality of the display device 11 may be further improved.

Hereinafter, another embodiment of the display device will be described. In the following description of one or more embodiments, the same or substantially the same configuration and/or elements as those of one or more of the previously described embodiments may be denoted by the same reference symbols, and thus, redundant description thereof may be simplified or may not be repeated, and differences thereof may be mainly described.

Figure 15:
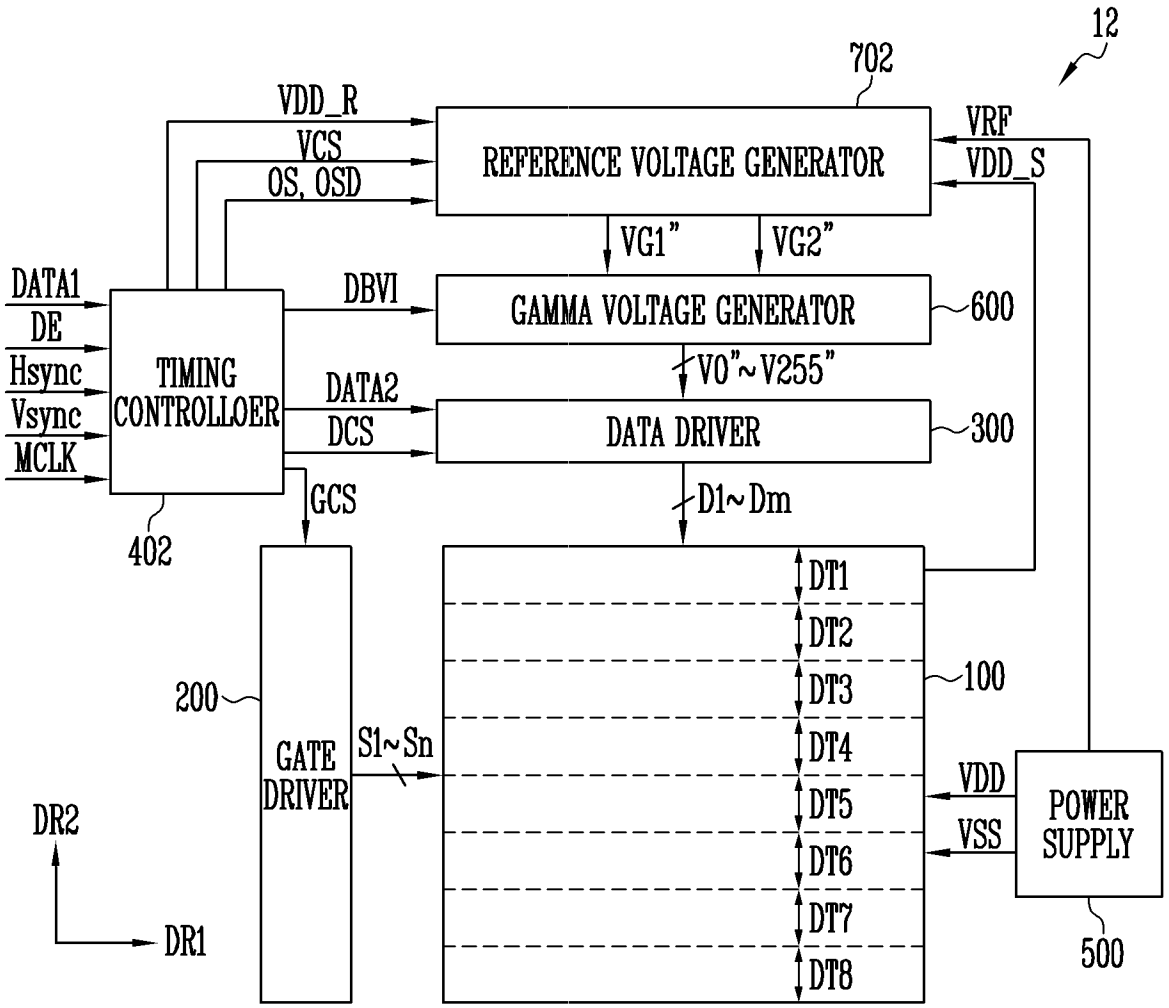
FIG. 15 is a diagram illustrating a display device according to another embodiment of the present disclosure.
Figure 16:
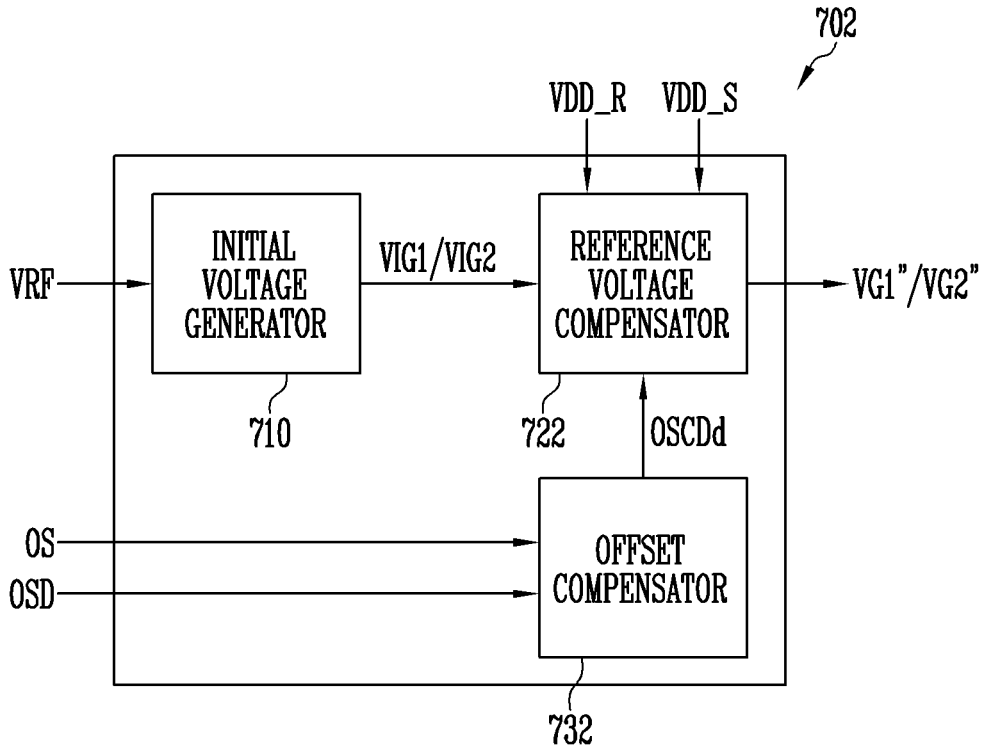
FIG. 16 is a diagram illustrating a reference voltage generator included in the display device of FIG. 15.
Figure 17:
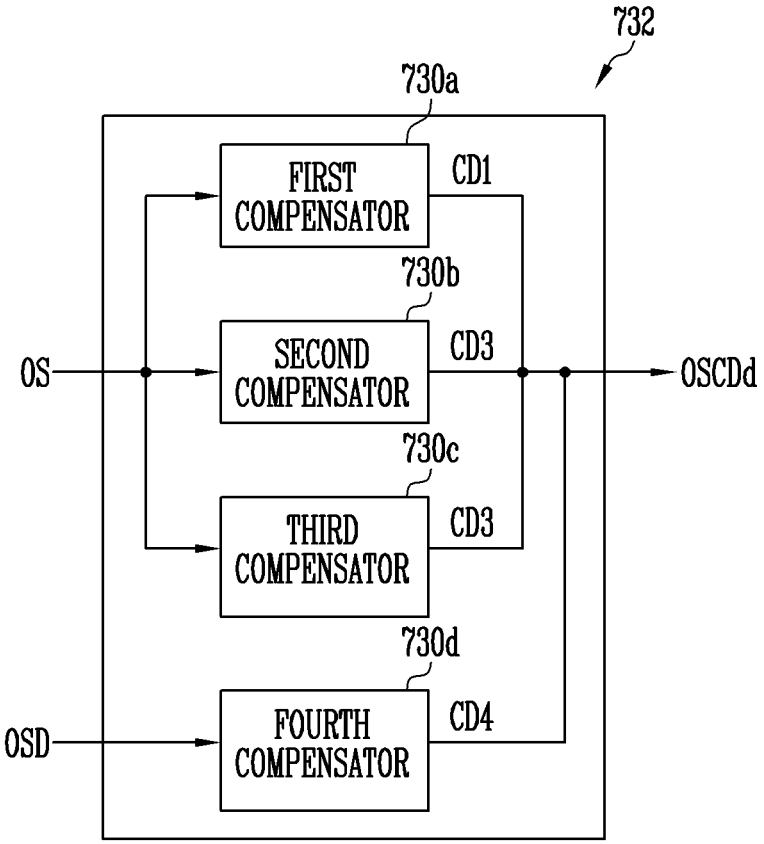
FIG. 17 is a diagram for illustrating an offset compensator included in the reference voltage generator of FIG. 16.

The one or more embodiments of FIGS. 15 to 17 may be different from the one or more embodiments of FIGS. 7 to 14 in that a reference voltage generator may further receive distance offset information, and may generate first and second reference voltages according to (e.g., based on) the distance offset information.

FIG. 15 is a diagram illustrating a display device according to another embodiment. FIG. 16 is a diagram illustrating the reference voltage generator included in the display device of FIG. 15. FIG. 17 is a diagram illustrating an offset compensator included in the reference voltage generator of FIG. 16.

Referring to FIGS. 15 to 17, a timing controller 402 of the display device 12 may further provide the distance offset information OSD to the reference voltage generator 702. The distance offset information OSD may include (e.g., may be) information corresponding to (e.g., set according to) a distance of which each of the pixels of the display unit 100 is spaced apart from the data driver 300.

In more detail, the display unit 100 may be divided into a plurality of areas DT1 to DT8. Each of the areas DT1 to DT8 may be areas extending along the first direction DR1, and arranged along the second direction DR2. FIG. 15 illustrates that the display unit 100 includes eight areas DT1 to DT8, but the present disclosure is not limited thereto. The first to eighth areas DT1 to DT8 may be sequentially arranged along the second direction DR2 according to the distance from the data driver 300.

The distance offset information OSD may be determined according to the distance between the areas DT1 to DT8 of the display unit 100 and the data driver 300. The distance offset information OSD of the first area DT1 closest to the data driver 300 may have a lowest offset level, and the distance offset information OSD of the eighth area DT8 farthest from the data driver 300 may have a highest offset level. The distance offset information OSD of the second to seventh areas DT2 to DT7 may be determined as values between the offset level of the first area DT1 and the offset level of the eighth area DT8.

A variation (e.g., a change or a deviation) of the data signals transferred through the data lines D1 to Dm may increase as the distance from the data driver 300 increases. For example, a time delay, a voltage drop, and/or the like may occur in the data signals due to a line resistance of the data lines D1 to Dm and/or a capacitance generated between lines.

Therefore, the timing controller 402 may set the distance offset information OSD, and may provide the distance offset information OSD to the reference voltage generator 702.

The reference voltage generator 702 may generate the first reference voltage VG1" and the second reference voltage VG2" according to (e.g., based on) the provided distance offset information OSD. In more detail, the reference voltage generator 702 may include an offset compensator 732, and the offset compensator 732 may include a fourth compensator 730*d*.

The fourth compensator 730*d* may receive the distance offset information OSD, and may generate fourth compensation data CD4 (e.g., distance compensation data) corresponding thereto. For example, the fourth compensator 730*d* may generate the fourth compensation data CD4 by referring to a look-up table in which a distance compensation value is determined according to an offset level of the distance offset information OSD. The fourth compensation data CD4 may include at least one compensation data from among the time delay, the slew rate, and the gain compensation data of the reference voltages. A compensation level of the fourth compensation data CD4 may be determined in correspondence with the offset level (e.g., the distance from the data driver 300) of the distance offset information OSD.

When the data offset information OS of different pixel rows is the same or substantially the same as each other, time delays, slew rates, and/or gains compensated according to the distance offset information OSD determined according to the distance from the data driver 300 may be different. For example, when the data offset information OS of different pixel rows is the same or substantially the same as each other, a control time point of a pixel row of which the distance offset level is higher may be earlier. In addition, the slew rate of the reference voltages may be adjusted larger, and the gain may be adjusted larger in the pixel row of which the distance offset level is higher.

The reference voltage compensator 722 may receive offset compensation data OSCDd further including the fourth compensation data CD4 according to the distance offset information OSD, and the reference voltage compensator 722 may generate the first reference voltage VG1" and the second reference voltage VG2" according to (e.g., based on) the first and second initial reference voltages VIG1 and VIG2, the reference driving voltage VDD_R, the sensing driving voltage VDD_S, and the offset compensation data OSCDd.

The gamma voltage generator 600 may generate grayscale voltages V0" to V255" according to (e.g., based on) the first reference voltage VG1" and the second reference voltage VG2". The data driver 300 may generate the data signals according to (e.g., based on) the grayscale voltages V0" to V255", and may provide the data signals to the data lines D1 to Dm in units of a pixel row (e.g., in a pixel row unit).

As described above, the time delay, the voltage drop, and/or the like may occur in the data signals as the distance from the data driver 300 increases, for example, due to the line resistance and/or the capacitance between the lines. Therefore, the display device 12 according to the present embodiment may further set the distance offset information OSD according to the distance from the data driver 300, and may provide the distance offset information OSD to the reference voltage generator 702. Accordingly, the reference voltages VG1" and VG2" may be more precisely compensated, and the display quality of the display device 12 may be further improved.

Figure 18:
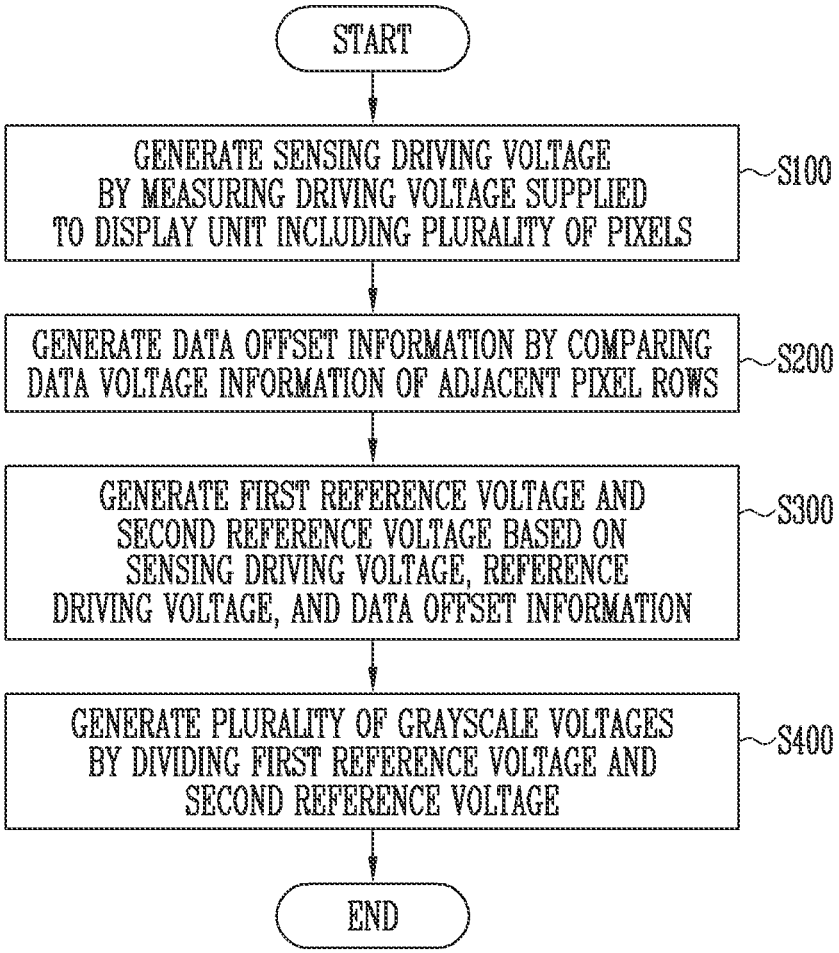
FIGS. 18-19 are flowcharts illustrating a method of driving a display device according to one or more embodiments.
Figure 19:
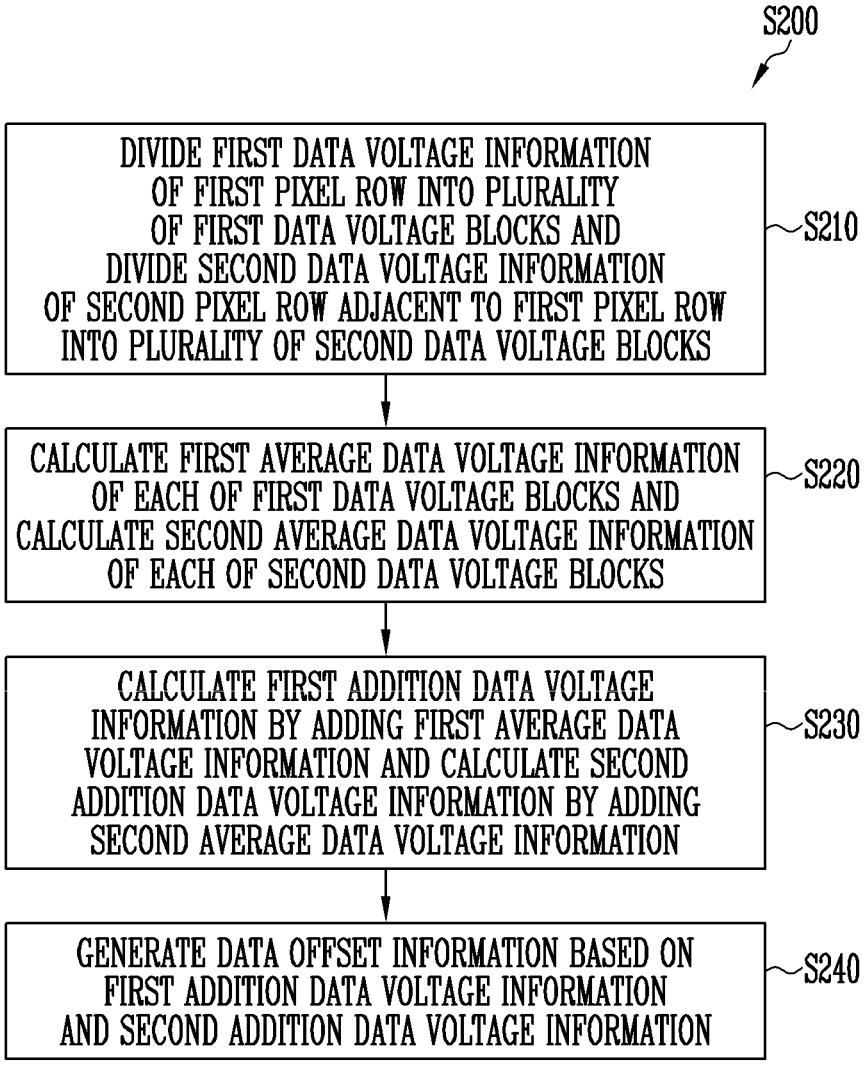

FIGS. 18 and 19 are flowcharts illustrating a method of driving a display device according to one or more embodiments.

Referring to FIGS. 1 to 19, the method of driving the display device according to one or more embodiments may generate the sensing driving voltage VDD_S by measuring the driving voltage VDD supplied to the display unit 100 including the plurality of pixels PX (S100).

As described above, the first driving voltage VDD generated by the power supply 500 and provided to the display unit 100 may be delayed due to the resistances of the lines for transferring the first driving voltage VDD to each of the pixels PX and/or the capacitance between other lines, and thus, voltage drops may occur. In other words, the driving voltage provided to (e.g., substantially provided to) each of the pixels PX may be the sensing driving voltage VDD_S, and may be different from the first driving voltage VDD generated by the power supply 500.

Therefore, the driving method of FIG. 18 may generate the sensing driving voltage VDD_S by measuring the driving voltage provided to each of the pixels PX.

Thereafter, the driving method of FIG. 18 may generate the data offset information by comparing data voltage information of adjacent pixel rows (S200).

As described with reference to FIG. 8, the driving method of FIG. 18 may compare the data voltage information DVa and DVb of the adjacent pixel rows through the comparator 430 of the timing controller 401, and may generate the data offset information OS according to (e.g., based on) the data voltage information DVa and DVb.

Referring to FIG. 19, in some embodiments, as described with reference to FIG. 9, the operation S200 of generating the data offset information OS may include dividing the first data voltage information DVa applied to the first pixel row into the plurality of first data voltage blocks DVa[1] to DVa[p], and dividing the second data voltage information applied to the second pixel row adjacent to the first pixel row into the plurality of second data voltage blocks DVb[1] to DVb[p] (S210). The first average data voltage information AVa[1] to AVa[p] of each of the first data voltage blocks DVa[1] to DVa[p] may be calculated, and the second average data voltage information AVb[1] to AVb[p] of each of the second data voltage blocks DVb[1] to DVb[p] may be calculated (S220). The first addition data voltage information AVa_S may be calculated by adding the first average data voltage information AVa[1] to AVa[p], and the second addition data voltage information AVb_S may be calculated by adding the second average data voltage information AVb[1] to AVb[p] (S230). Further, the data offset information OS may be generated according to (e.g., based on) the first addition data voltage information AVa_S and the second addition data voltage information AVb_S (S240).

The offset level of the data offset information OS may be determined according to the difference between the first addition data voltage information AVa_S and the second addition data voltage information AVb_S. As the difference between the first addition data voltage information AVa_S and the second addition data voltage information AVb_S increases, the offset level of the data offset information OS may increase, and as the difference between the first addition data voltage information AVa_S and the second addition data voltage information AVb_S decreases, the offset level of the data offset information OS may decrease. In other words, the offset level of the data offset information OS may be determined according to the difference between the data voltage information DVa and DVb of the adjacent pixel rows.

Referring again to FIG. 18, the driving method of FIG. 18 may generate the first reference voltage VG1 and the second reference voltage VG2 according to (e.g., based on) the sensing driving voltage VDD_S, the reference driving voltage VDD_R, and the data offset information OS (S300). The plurality of grayscale voltages V0 to V255 may be generated by dividing the first reference voltage VG1 and the second reference voltage VG2 (S400).

As described above, the offset level of the data offset information OS may be determined according to the difference between the data voltage information DVa and DVb of adjacent pixel rows. Therefore, as described with reference to FIGS. 11 to 14, the time delay, the slew rate, and/or the gain of the first reference voltage and the second reference voltage may be controlled (e.g., may be compensated for) according to the offset level of the data offset information OS.

For example, as the offset level of the data offset information OS increases, the reference voltages may be adjusted so that the control time point (or voltage control time point) is earlier. In addition, as the offset level increases, the slew rate and the gain of the reference voltages may be adjusted to be increased.

As described above, the driving method of FIG. 18 may reflect the difference between the reference driving voltage VDD_R and the sensing driving voltage VDD_S when generating the first reference voltage VG1 and the second reference voltage VG2. In addition, because the driving method of FIG. 18 may control the first reference voltage VG1 and the second reference voltage VG2 according to (e.g., based on) the data offset information OS reflecting the difference of the data voltages applied to the adjacent pixel rows, the driving method of FIG. 18 may effectively compensate for the variation (e.g., the change or the deviation) of the first driving voltage VDD through the first reference voltage VG1 and the second reference voltage VG2, and the display quality of the display device may be improved.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the present disclosure.

Although some example embodiments have been described, those skilled in the art will readily appreciate that various modifications are possible in the example embodiments without departing from the spirit and scope of the present disclosure. It will be understood that descriptions of features or aspects within each embodiment should typically be considered as available for other similar features or aspects in other embodiments, unless otherwise described. Therefore, it is to be understood that the foregoing is illustrative of various example embodiments and is not to be construed as limited to the specific example embodiments disclosed herein, and that various modifications to the disclosed example embodiments, as well as other example embodiments, are intended to be included within the spirit and scope of the present disclosure as defined in the appended claims, and their equivalents.

What is claimed is:

1. A display device comprising:

a display unit comprising a plurality of pixels configured to display an image according to a driving voltage;

a data driver configured to provide data signals to the plurality of pixels;

a gamma voltage generator configured to provide a plurality of grayscale voltages to the data driver; and a reference voltage generator configured to receive data offset information corresponding to a difference between data voltage information of adjacent pixel rows, and to provide a first reference voltage and a second reference voltage to the gamma voltage generator, wherein the gamma voltage generator is configured to generate the plurality of grayscale voltages by dividing the first reference voltage and the second reference voltage, and the reference voltage generator is configured to generate a sensing driving voltage by measuring the driving voltage from the display unit, and to generate the first reference voltage and the second reference voltage by utilizing the data offset information, the sensing driving voltage, and a reference driving voltage.

2. A display device comprising:

a display unit comprising a plurality of pixels configured to display an image according to a driving voltage;

a data driver configured to provide data signals to the plurality of pixels;

a gamma voltage generator configured to provide a plurality of grayscale voltages to the data driver;

a reference voltage generator configured to provide a first reference voltage and a second reference voltage to the gamma voltage generator; and a timing controller configured to compare data voltage information of adjacent pixel rows to generate data offset information, and to provide the data offset information to the reference voltage generator, wherein the gamma voltage generator is configured to generate the plurality of grayscale voltages by dividing the first reference voltage and the second reference voltage, the reference voltage generator is configured to generate a sensing driving voltage by measuring the driving voltage from the display unit, and to generate the first reference voltage and the second reference voltage by utilizing the sensing driving voltage and a reference driving voltage, and wherein the reference voltage generator is configured to control the first reference voltage and the second reference voltage according to the data offset information, the sensing driving voltage, and the reference driving voltage.

3. The display device according to claim 2, wherein the timing controller comprises:

an image processor configured to convert first image data into second image data;

memory configured to receive the second image data from the image processor, and to store the second image data; and a comparator configured to receive first data voltage information of a first pixel row of the second image data and second data voltage information of a second pixel row adjacent to the first pixel row of the second image data from the memory, and to output the data offset information according to a difference between the first data voltage information and the second data voltage information.

4. The display device according to claim 3, wherein the comparator comprises:

a first data average calculator configured to divide the first data voltage information into a plurality of first data voltage blocks, and to calculate first average data voltage information by calculating an average of each of the plurality of first data voltage blocks;

a second data average calculator configured to divide the second data voltage information into a plurality of second data voltage blocks, and to calculate second average data voltage information by calculating an average of each of the plurality of second data voltage blocks;

a first adder configured to add the first average data voltage information to calculate first addition data voltage information;

a second adder configured to add the second average data voltage information to calculate second addition data voltage information; and an offset provider configured to generate the data offset information according to a difference between the first addition data voltage information and the second addition data voltage information.

5. The display device according to claim 3, wherein a time point at which the memory provides the first data voltage information to the comparator is earlier than a time point at which the memory provides the first data voltage information to the data driver.

6. The display device according to claim 5, wherein the memory is configured to provide the second data voltage information of the second pixel row to the comparator at a time point at which the memory provides the first data voltage information of the first pixel row to the data driver, and the second pixel row is a next pixel row that is adjacent to the first pixel row.

7. The display device according to claim 2, wherein the reference voltage generator is configured to control at least one of a time delay, a slew rate, and a gain of the first reference voltage and the second reference voltage according to an offset level of the data offset information, and the offset level of the data offset information increases as a difference of the data voltage information of the adjacent pixel rows increases, and decreases as the difference of the data voltage information of the adjacent pixel rows decreases.

8. The display device according to claim 7, wherein the reference voltage generator is configured to control a voltage change time point of the first reference voltage and the second reference voltage to be earlier as the offset level increases.

9. The display device according to claim 7, wherein the reference voltage generator is configured to control the slew rate of the first reference voltage and the second reference voltage to increase as the offset level increases.

10. The display device according to claim 7, wherein the reference voltage generator is configured to control the gain of the first reference voltage and the second reference voltage to increase as the offset level increases.

11. The display device according to claim 2, wherein the timing controller is further configured to:

provide distance offset information to the reference voltage generator; and generate the distance offset information according to a separation distance between the plurality of pixels and the data driver, and the reference voltage generator is configured to control the first reference voltage and the second reference voltage according to the data offset information, the distance offset information, the sensing driving voltage, and the reference driving voltage.

12. The display device according to claim 11, wherein the reference voltage generator is configured to control at least one of a time delay, a slew rate, and a gain of the first reference voltage and the second reference voltage according to an offset level of the distance offset information, and the offset level of the distance offset information increases as the separation distance increases, and decreases as the separation distance decreases.

13. The display device according to claim 1, wherein the reference voltage generator comprises:

a first differential amplifier configured to output the first reference voltage according to a difference between the sensing driving voltage and the reference driving voltage; and a second differential amplifier configured to output the second reference voltage according to a difference between the sensing driving voltage and the reference driving voltage.

14. The display device according to claim 1, wherein the reference driving voltage is a target driving voltage for normally driving the plurality of pixels.

15. A method of driving a display device, the method comprising:

generating a sensing driving voltage by measuring a driving voltage supplied to a display unit comprising a plurality of pixels;

generating data offset information by comparing data voltage information of adjacent pixel rows;

generating a first reference voltage and a second reference voltage according to the sensing driving voltage, a reference driving voltage, and the data offset information; and generating a plurality of grayscale voltages by dividing the first reference voltage and the second reference voltage.

16. The method according to claim 15, wherein the generating of the first reference voltage and the second reference voltage comprises controlling at least one of a time delay, a slew rate, and a gain of the first reference voltage and the second reference voltage according to an offset level of the data offset information, and the offset level increases as a difference of the data voltage information of adjacent pixel rows increases, and decreases as the difference of the data voltage information of the adjacent pixel rows decreases.

17. The method according to claim 16, wherein a control time point of the first reference voltage and the second reference voltage is controlled to be earlier as the offset level increases.

18. The method according to claim 16, wherein the slew rate of the first reference voltage and the second reference voltage is controlled to increase as the offset level increases.

19. The method according to claim 16, wherein the gain of the first reference voltage and the second reference voltage is controlled to increase as the offset level increases.

20. The method according to claim 15, wherein the generating of the data offset information comprises:

dividing first data voltage information of a first pixel row into a plurality of first data voltage blocks;

dividing second data voltage information of a second pixel row adjacent to the first pixel row into a plurality of second data voltage blocks;

calculating first average data voltage information of each of the first data voltage blocks;

calculating second average data voltage information of each of the second data voltage blocks;

calculating first addition data voltage information by adding the first average data voltage information;

calculating second addition data voltage information by adding the second average data voltage information; and generating the data offset information according to the first addition data voltage information and the second addition data voltage information.

* * * * *